US012723837B2

(12) United States Patent
Warburton et al.

(10) Patent No.: US 12,723,837 B2
(45) Date of Patent: Sep. 1, 2026

(54) FIREARM ACCESSORY MOUNTING SYSTEM

(71) Applicant: Sturm, Ruger & Company, Inc., Southport, CT (US)

(72) Inventors: Scott Warburton, South Acworth, NH (US); John M. French, Meridian, ID (US)

(73) Assignee: Sturm, Ruger & Company, Inc.

( * ) Notice: Subject to any disclaimer, the term of this patent is extended or adjusted under 35 U.S.C. 154(b) by 0 days.

(21) Appl. No.: 18/974,520

(22) Filed: Dec. 9, 2024

(65) Prior Publication Data

US 2026/0160520 A1 Jun. 11, 2026

(51) Int. Cl.
*F41C 23/16* (2006.01)
*F41A 23/02* (2006.01)

(52) U.S. Cl.
CPC ..... *F41C 23/16* (2013.01); *F41A 23/02* (2013.01)

(58) Field of Classification Search
CPC ..... F41C 23/16; F41A 23/02; F41A 11/02; F41A 17/38; F41A 19/11; F41A 3/66; F41A 3/12
See application file for complete search history.

(56) References Cited

U.S. PATENT DOCUMENTS 2,997,803 A * 8/1961 Florence ..... F41A 9/70 42/50
3,062,114 A 11/1962 Palos
3,206,885 A * 9/1965 Dye ..... F41C 23/00 42/75.03
3,803,739 A * 4/1974 Haines ..... F41A 9/70 42/6

(Continued)

FOREIGN PATENT DOCUMENTS

AU 2016100079 A4 3/2016
CN 108871050 A 11/2018

(Continued)

OTHER PUBLICATIONS

International Search Report and Written Opinion for PCT/US2025/058577, issued Feb. 23, 2026.

*Primary Examiner* — Joshua E Freeman
(74) *Attorney, Agent, or Firm* — The Belles Group, P.C.

(57) ABSTRACT

An accessory rail mounting system for a firearm comprises an elongated stock defining a downwardly open magazine well cavity, and a magazine well insert comprising an elongated body including a mounting portion and elongated coupling rail cantilevered from the mounting portion. The mounting portion is configured for detachable mounting to a bottom surface of the stock at the magazine well cavity. Threaded fasteners may be used for mounting. The mounting portion includes an elongated magazine aperture configured to receive an ammunition magazine therethrough (Continued)

and latching feature configured to engage a latch of the magazine to releasably retain the magazine in the firearm. The coupling rail is configured to detachably couple and mount a firearm accessory thereto. The coupling rail may have numerous rail configurations compatible with mounting interfaces of various types of firearm accessories, such as bipods, tripods, and other accessories. Mounting portions may be varied to accept different magazines.

21 Claims, 28 Drawing Sheets

(56) References Cited

U.S. PATENT DOCUMENTS

| | | | | |
|---|---|---|---|---|
| 3,830,003 | A | 8/1974 | Clerke | |
| 4,237,638 | A * | 12/1980 | Trexler | F41A 11/02 42/6 |
| 5,074,188 | A | 12/1991 | Harris | |
| 5,899,013 | A * | 5/1999 | Hauser | F41A 17/38 42/6 |
| 6,272,785 | B1 | 8/2001 | Mika et al. | |
| 6,318,014 | B1 | 11/2001 | Porter | |
| 6,698,127 | B2 | 3/2004 | Weber | |
| 7,191,557 | B2 | 3/2007 | Gablowski et al. | |
| 7,222,451 | B2 | 5/2007 | Keng et al. | |
| 7,431,247 | B2 | 10/2008 | Bobro | |
| 8,316,570 | B2 | 11/2012 | Potterfield et al. | |
| 8,359,780 | B2 | 1/2013 | Peterson et al. | |
| 8,904,693 | B1 | 12/2014 | Beltz | |
| 9,488,437 | B1 | 11/2016 | Schnog | |
| 9,513,087 | B2 | 12/2016 | Barger | |
| 9,939,225 | B2 | 4/2018 | Ravnaas | |
| 10,317,163 | B2 * | 6/2019 | Poindexter | F41A 23/02 |
| 10,415,920 | B2 | 9/2019 | Haskell et al. | |
| 10,415,922 | B2 | 9/2019 | Reik | |
| 10,443,973 | B2 | 10/2019 | Bofill | |
| 10,612,718 | B2 | 4/2020 | Johnson, Sr. et al. | |
| 10,718,588 | B2 | 7/2020 | Gyurec et al. | |
| 10,808,880 | B1 | 10/2020 | Gearing | |
| 10,876,813 | B2 * | 12/2020 | Olheiser | F41G 11/001 |
| 10,921,082 | B2 | 2/2021 | Todd | |
| 11,391,534 | B1 | 7/2022 | Azhocar | |
| 11,656,051 | B2 | 5/2023 | Lee et al. | |
| 2008/0060247 | A1 * | 3/2008 | Thomele | F41A 3/66 42/71.02 |
| 2011/0061283 | A1 | 3/2011 | Cavallo et al. | |
| 2012/0085009 | A1 * | 4/2012 | Crow | F41A 3/66 42/6 |
| 2017/0030667 | A1 * | 2/2017 | Eitan | F41A 11/02 |
| 2017/0153084 | A1 | 6/2017 | Tarazi | |
| 2017/0254615 | A1 * | 9/2017 | Kennair, Jr. | F41G 11/003 |
| 2018/0335266 | A1 * | 11/2018 | Cochran | F41A 17/38 |
| 2019/0331459 | A1 | 10/2019 | Johnson, Sr. et al. | |
| 2019/0331460 | A1 | 10/2019 | Johnson, Sr. et al. | |
| 2021/0108876 | A1 | 4/2021 | Thomas | |
| 2021/0278153 | A1 * | 9/2021 | Heuss | F41A 3/66 |
| 2023/0160652 | A1 | 5/2023 | Ingram et al. | |
| 2024/0133651 | A1 * | 4/2024 | Batten | F41A 23/12 |
| 2024/0300071 | A1 * | 9/2024 | Parris | F41G 11/003 |
| 2025/0347482 | A1 * | 11/2025 | Hawthorn | F41A 3/66 |

FOREIGN PATENT DOCUMENTS

| | | | |
|---|---|---|---|
| DE | 10301170 | B4 | 8/2004 |
| DE | 202020100525 | U1 | 2/2020 |
| EP | 3452775 | B1 | 11/2022 |
| ES | 2658387 | A1 | 3/2018 |
| WO | 2021/205043 | A2 | 10/2021 |
| WO | 2022/150745 | A1 | 7/2022 |
| WO | 2022/233780 | A1 | 11/2022 |
| WO | 2022/233792 | A1 | 11/2022 |
| WO | 2022/233794 | A1 | 11/2022 |
| WO | 2022/233852 | A1 | 11/2022 |

* cited by examiner

FIREARM ACCESSORY MOUNTING SYSTEM

BACKGROUND

The present invention generally relates to firearms, and more particularly to a mounting system for detachably coupling a firearm accessory such as without limitation a firearm support or other type accessory to a long gun such as for example a rifle, carbine, or shotgun.

Various types of accessories are available for mounting to a long gun to aid user in operating and handling the firearm. As one example to improve the shooting accuracy of such long guns for hunting and certain types of competitive shooting matches, it is often desirable to stabilize the firearm using a support device such as a bipod or tripod as some non-limiting examples. This steadies the firearm so that the shooter can focus on aiming whether standing, crouching, or lying down. Bipods or tripods typically have spreadable and telescoping legs which engage a support surface. These firearm support devices are in turn coupled to the firearm via a mount of some type compatibly configured with the mounting interface of the support device which accepts the particular mount configuration.

Various types of mounting interfaces may be used to couple the bipod or tripod to the firearm chassis or stock. Some firearm support device mounts require brackets of various types which can be bulky and are not easily integrated into the original profile of the firearm chassis or stock without drastically detracting from the aesthetic appearance of the firearm. In addition, some support device mounts must be screwed directly into the firearm, thereby permanently damaging the stock which disfigures the firearm if used without the tripod mount in place. Some firearm support devices are configured for coupling to existing accessory rails on the firearm such as Picatinny rails, ARCA-type dovetail rails, M-LOK® rails standard dovetail rails, or others. While such accessory rails are commonly used on AR type long guns (e.g., rifles or carbines), certain long guns of an appearance which replicates classic or traditional wooden stocks such as bolt action rifles have heretofore lacked a convention way to add such rails due to the stock configuration.

Improvements in firearm accessory mounting systems for long guns are desired which can overcome the foregoing deficiencies to allow a broad variety of accessories to be mounted to long guns.

SUMMARY OF THE INVENTION

Embodiments of the present invention provide an accessory rail mounting system configured and operable for detachably coupling a firearm accessory to the chassis or stock of the firearm. In one embodiment, the firearm accessory may be a firearm support device such as for example without limitation a bipod, tripod, or any other device or structure which can at least partially support and steady the firearm from a support surface to aid the user in aiming and shooting. However, other type of accessories commonly adapted to mount to an accessory rail may be used such a flashlights, laser sights, vertical grips, and sling mounts for carrying the firearm, and others. Another option is to use the accessory rail mounting system as a storage aid such as a way of transporting the firearm in a firearm rack or mount on an ATV (all terrain vehicle) or off road vehicle. The firearm may be a long gun in certain preferred but non-limiting embodiments such as a rifle, carbine, or shotgun as some examples.

In one embodiment, the accessory rail mounting system may comprise a rail coupling apparatus in the form of a stock insert detachably mountable to the bottom of the stock, and more particularly to the mid-stock in some embodiments which supports the receiver. The stock insert in one embodiment comprises a longitudinally/axially elongated body including a mounting portion configured to coupling to the firearm stock, and an elongated coupling rail cantilevered from the mounting portion for detachably mounting a firearm accessory thereto.

The stock insert may have a variety of different configurations and functionality in various embodiments as disclosed herein. In one non-limiting embodiment, for example, the stock insert may be configured to function as a magazine well insert. The mounting portion of the magazine well insert in one non-limiting implementation may be at least partially insertable into an elongated entrance recess defined by a lower portion of the magazine well cavity formed in the stock of the firearm which receives the ammunition magazine. In other embodiments, the mounting portion might not enter the recess and be surface mounted on the bottom of the stock. The magazine well insert is therefore detachably mounted to the bottom of the firearm stock at the magazine well cavity below the breech area of the action in one embodiment. Several configurations of magazine well inserts are disclosed herein which are compatible with the various types of possible ammunition magazine arrangements used in firearms including without limitation magazines requiring complete removal from the stock and replacement when fresh new cartridges are required, and magazines which remain in the stock such that new cartridges are manually loaded into the magazine without removing the magazine.

In one embodiment, the magazine well insert is configured to releasably receive and retain a detachable-type ammunition magazine of the first type noted above which holds a plurality of ammunition cartridges. The mounting portion of the magazine well insert may be detachably coupled to the firearm stock via threaded fasteners. The magazine well insert for the detachable type of magazine includes an elongated longitudinal aperture through which the removable magazine is inserted into the magazine well cavity of the stock for feeding cartridges into the breech area.

The cantilevered coupling rail of the magazine well insert protrudes forward from the mounting portion, and in some embodiments the rear end of the rail may also extend downwards from the mounting portion of the insert to clear the bottom surface of the mid-stock forward of the insert. The coupling rail is configured to mate with the coupling mechanism and mounting interface of the firearm accessory such as a support device (e.g., bipod, tripod, or other) which is configured to detachably receive and retain the coupling rail which in turn supports the firearm via the magazine well insert in a fixed and stable manner from any suitable support surface (e.g., ground, table, platform, equipment, vehicle, etc.).

In one embodiment, the magazine well insert is configured and operable to retain a box type magazine with straight or curved magazine body or tube. In other embodiments, the magazine well insert may be configured and operable to retain a rotary type magazine. These foregoing magazine types are well known in the art and commercially-available without further undue explanation needed.

It bears noting that the general configuration of the stock insert including the mounting portion and associated coupling rail may be substantially the same for the stock inserts disclosed herein. In some embodiments, the stock insert may optionally include a trigger guard.

Various types of bipods and tripods for example have coupling mechanisms and interfaces specifically configured to mate with one of several different types of accessory rails commonly used on firearms in the art. The cantilevered coupling rail of the magazine well insert therefore may be provided and configured in a wide variety of different accessory rail types commonly used in the art and compatible with various firearm accessories. For example, without limitation, an ARCA rail is commonly used in photography for camera tripods may be used in some embodiments for mounting tripods or bipods. In various other embodiments, the coupling rail of the magazine well insert may also be for example without limitation a dovetail rail (with inverted trapezoidal cross-section), Picatinny rail, M-LOK® rail, or others commonly used in the firearm arts.

In one embodiment, the coupling rail may be integrally formed with the mounting portion of the magazine well insert body as a unitary structural part thereof which is inseparable, thereby forming a monolithic structure. This advantageously promotes a positive and streamlined aesthetic appearance when the magazine well is coupled to the stock. However, in other embodiments, the coupling rail may be detachably coupled to the mounting portion body of the magazine well insert such as via fasteners or other means. This forms an interchangeable rail system which allows the manufacturer or user to advantageously retain the single mounting portion of the magazine well insert and swap out various different type rails as needed or desired.

The magazine well insert with coupling rail in one embodiment has a cross sectional profile which is preferably contoured to generally conform to the original contours of the firearm stock in cross section profile without detracting from the overall aesthetic appearance of the firearm. By integrating the coupling rail for the firearm support device into the magazine well insert, an existing component of the firearm advantageously serves dual duty as both an ammunition magazine mounting mechanism and firearm support device coupling mechanism to reduce costs and preserve valuable space on the firearm for other accessories. In addition, the magazine well insert with integral coupling rail can be readily exchanged by the user with other magazine wells having different coupling rail configurations via employing simple tools (e.g., screwdriver), or exchanged with a conventional magazine well insert without a coupling rail when a firearm accessory such as a firearm support device or other will not be used. This beneficially allows the user to use the firearm with or without the coupling rail in a manner which does not permanently damage the stock caused by threaded fasteners or other coupling means.

In one embodiment, the mounting portion of the magazine well insert with integral coupling rail is configured to fit at least partially inside an axially/longitudinally elongated magazine well mounting recess formed in the bottom surface of the firearm stock (i.e. mid-stock) around the magazine well cavity, thereby resulting in a mounted insert which is at least partially or substantially flush with the stock (or projects a very minimal distance at most outwards therefrom). This advantageously retains the original profile of a traditionally curved and smoothly contoured stock to preserve the aesthetics of the firearm. In some embodiments, the magazine well insert may be arcuately curved from side to side to conform in a complementary manner to the transverse cross-sectional profile and contour of the stock. In other embodiments where the bottom surface of the stock might be flat, the magazine well insert may correspondingly be substantially flat from side to side to conform to such a stock profile. The coupling rail of the magazine well insert is substantially exposed for coupling to the firearm support device or other firearm accessory, whereas the mounting portion may be at least partially recessed into the bottom of the stock.

In one aspect, an accessory rail mounting system for a firearm comprises: a longitudinal axis; an elongated stock defining a downwardly open magazine well cavity; a stock insert comprising a longitudinally elongated body including a mounting portion configured for detachable mounting to a bottom surface of the stock at the magazine well cavity, and an elongated coupling rail cantilevered from the mounting portion; the coupling rail being configured to detachably couple a firearm accessory thereto. The coupling rail extends forwardly from the mounting portion of the magazine well insert. A rear end of the coupling rail may be vertically offset from the mounting portion of the magazine well insert forming a shoulder therebetween.

In another aspect, a magazine well insert with an accessory rail mounting system for a firearm comprises: a longitudinally elongated body including a mounting portion configured for detachable mounting to a bottom surface of a stock of the firearm at a magazine well cavity thereof, and an elongated coupling rail cantilevered from the mounting portion; the mounting portion including a longitudinally elongated magazine aperture configured to receive an ammunition magazine therethrough; the mounting portion comprising a magazine latching feature configured to releasably engage a latch lever of the magazine operable to retain the magazine in the magazine well insert; the coupling rail being configured to detachably couple a firearm accessory thereto.

In another aspect, a method is provided for coupling an accessory to a firearm comprising an elongated stock defining a downwardly open magazine well cavity. The method comprises: providing a first magazine well insert comprising an elongated body including a first mounting portion including an elongated magazine aperture, and an elongated first coupling rail cantilevered from the mounting portion, the first coupling rail having a first configuration; at least partially inserting the first mounting portion of the first magazine well insert into the magazine well cavity of the stock; coupling the first mounting portion of the first magazine well insert to the stock via installing threaded fasteners through the first mounting portion into the stock to retain the first magazine well insert to the stock; and coupling the accessory to the first coupling rail of the first magazine well insert. The method may further comprise after the step of coupling the first mounting portion of the magazine well insert to the stock, additional steps of inserting an ammunition magazine through the magazine aperture of first magazine well insert, and detachably retaining the magazine in the first magazine well insert. The step of detachably retaining the magazine in the first magazine well insert may comprise engaging a movable latch of the magazine with a latch surface formed in the magazine aperture of the first magazine well insert.

In another aspect, an accessory rail mounting system for a firearm comprises: a longitudinal axis; an elongated stock defining a downwardly open magazine well cavity; a stock insert comprising a longitudinally elongated body including a mounting portion configured for detachable mounting to a bottom surface of the stock at the magazine well cavity, and an elongated coupling rail cantilevered from the mounting portion; the coupling rail being configured to detachably couple a firearm accessory thereto.

BRIEF DESCRIPTION OF THE DRAWINGS

The features of the exemplary embodiments will be described with reference to the following drawings where like elements are labeled similarly, and in which.

Figure 1:
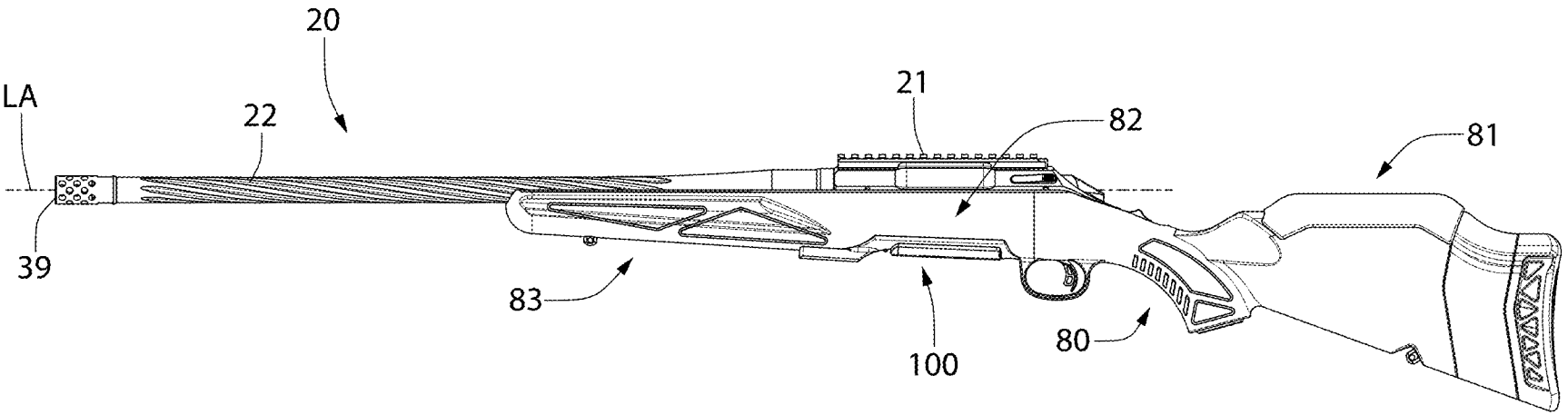
FIG. 1 is a left side view of a firearm with accessory rail mounting system according to the present disclosure showing a first embodiment of a stock insert configured as a magazine well insert with accessory coupling rail in the form of an ARCA rail.
Figure 2:
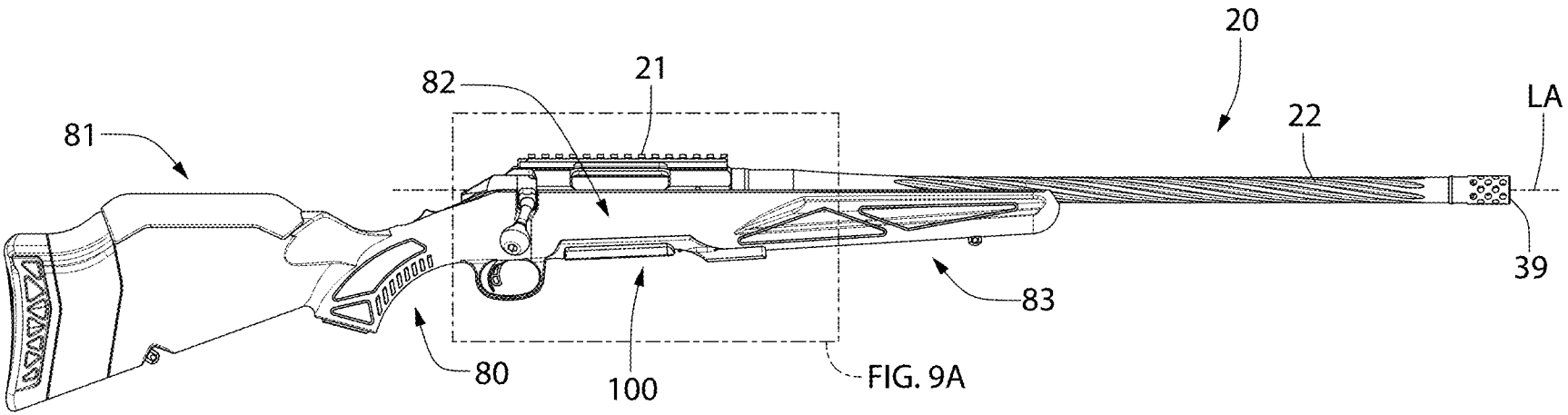
FIG. 2 is a right side view thereof.
Figure 3:
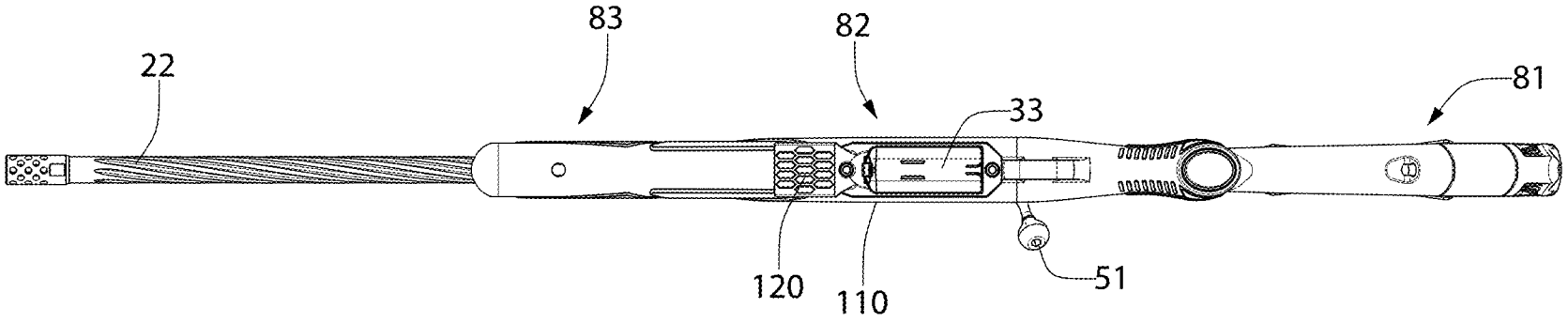
FIG. 3 is a bottom view thereof.
Figure 4:
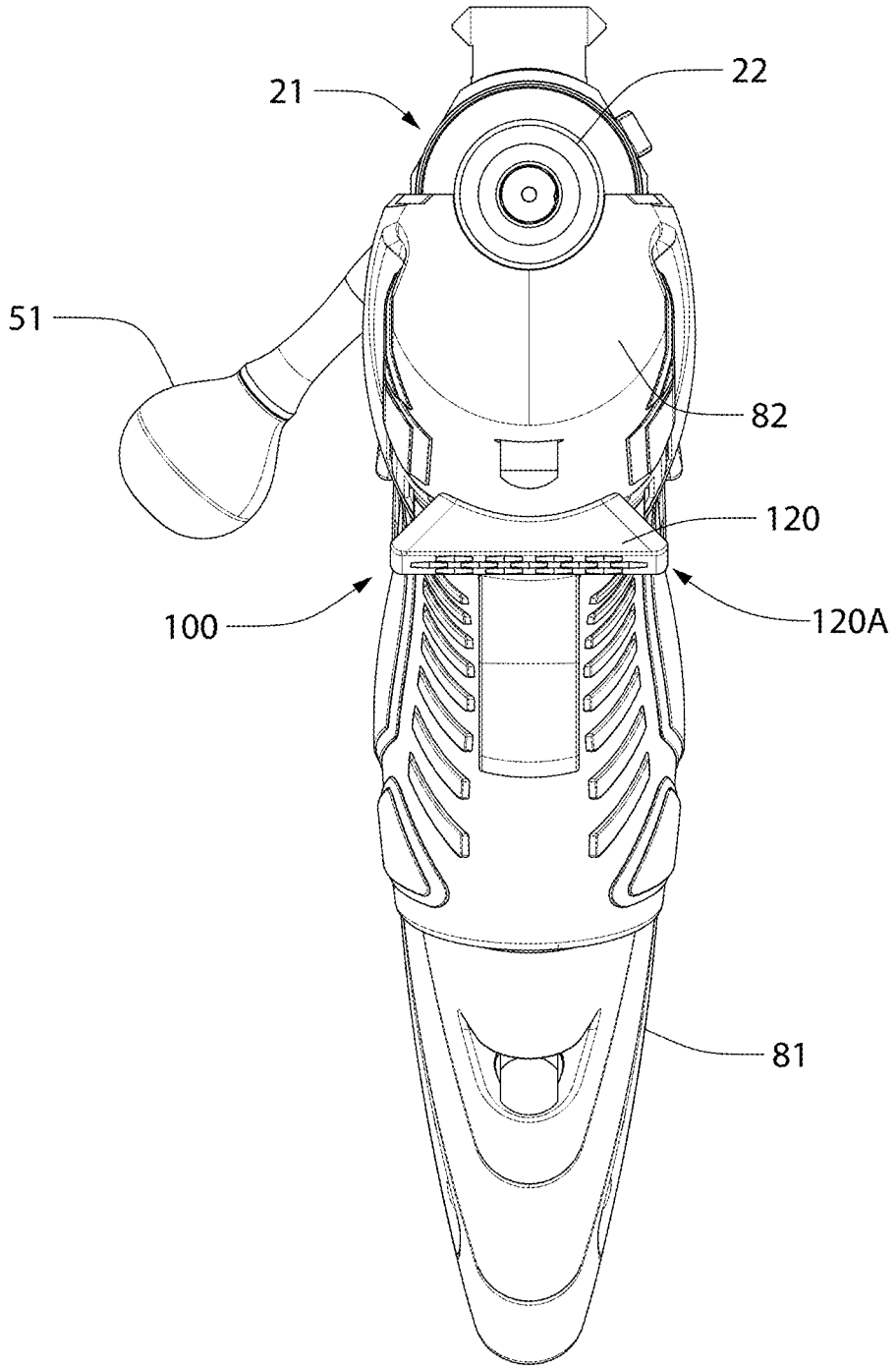
FIG. 4 is a front view thereof.
Figure 5:
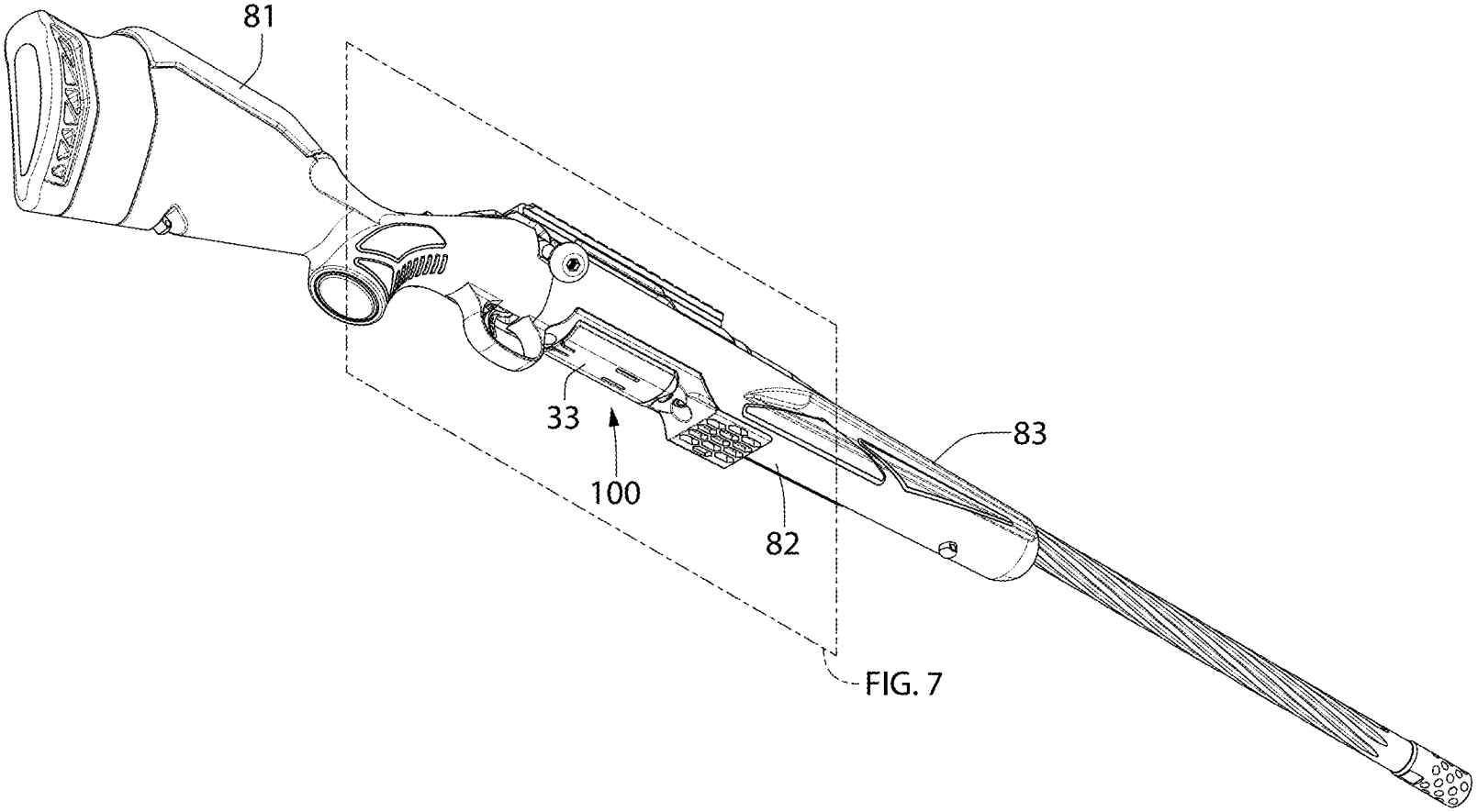
FIG. 5 is a bottom rear perspective view thereof.
Figure 6:
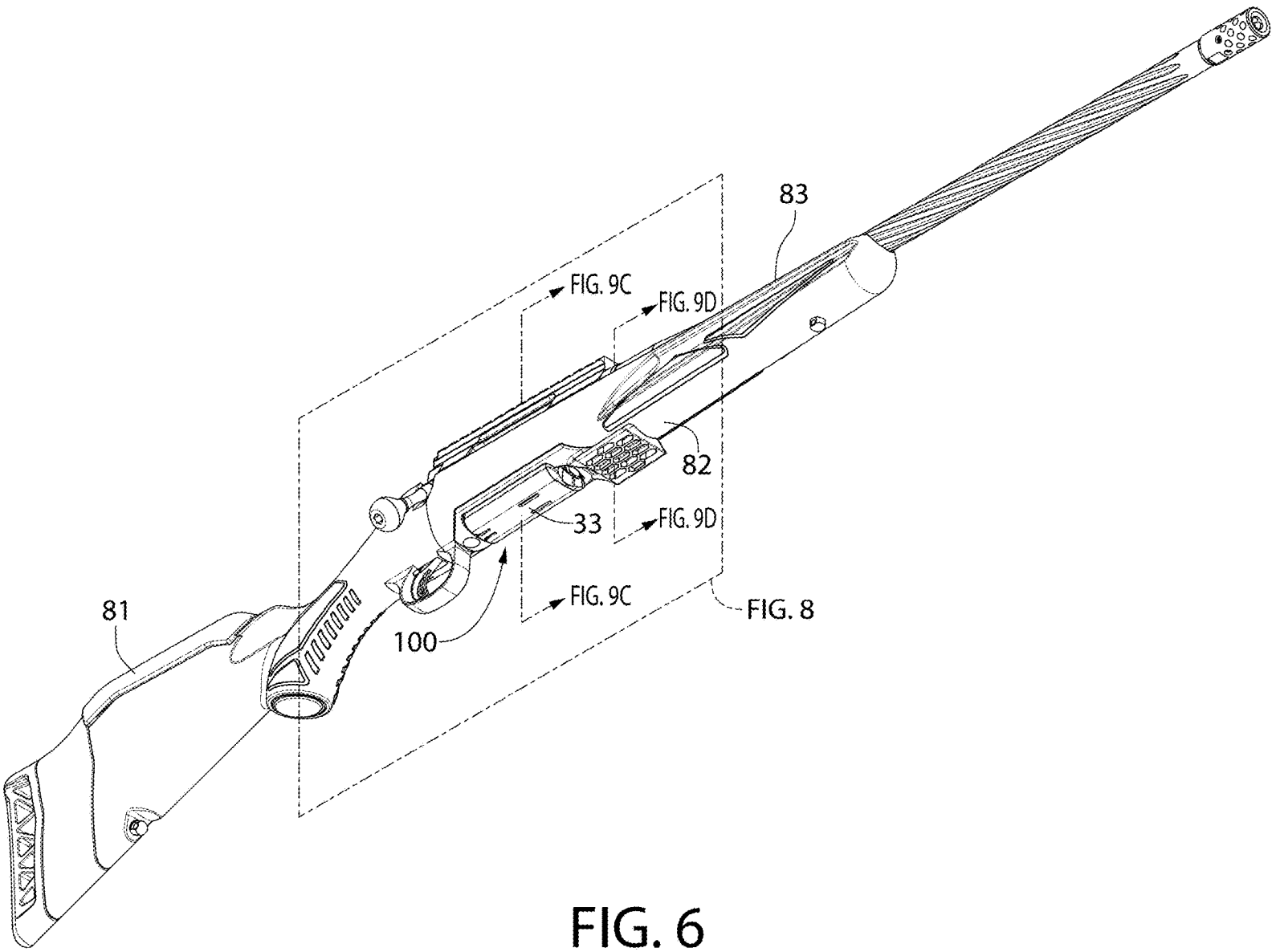
FIG. 6 is a bottom front perspective view thereof.
Figure 7:
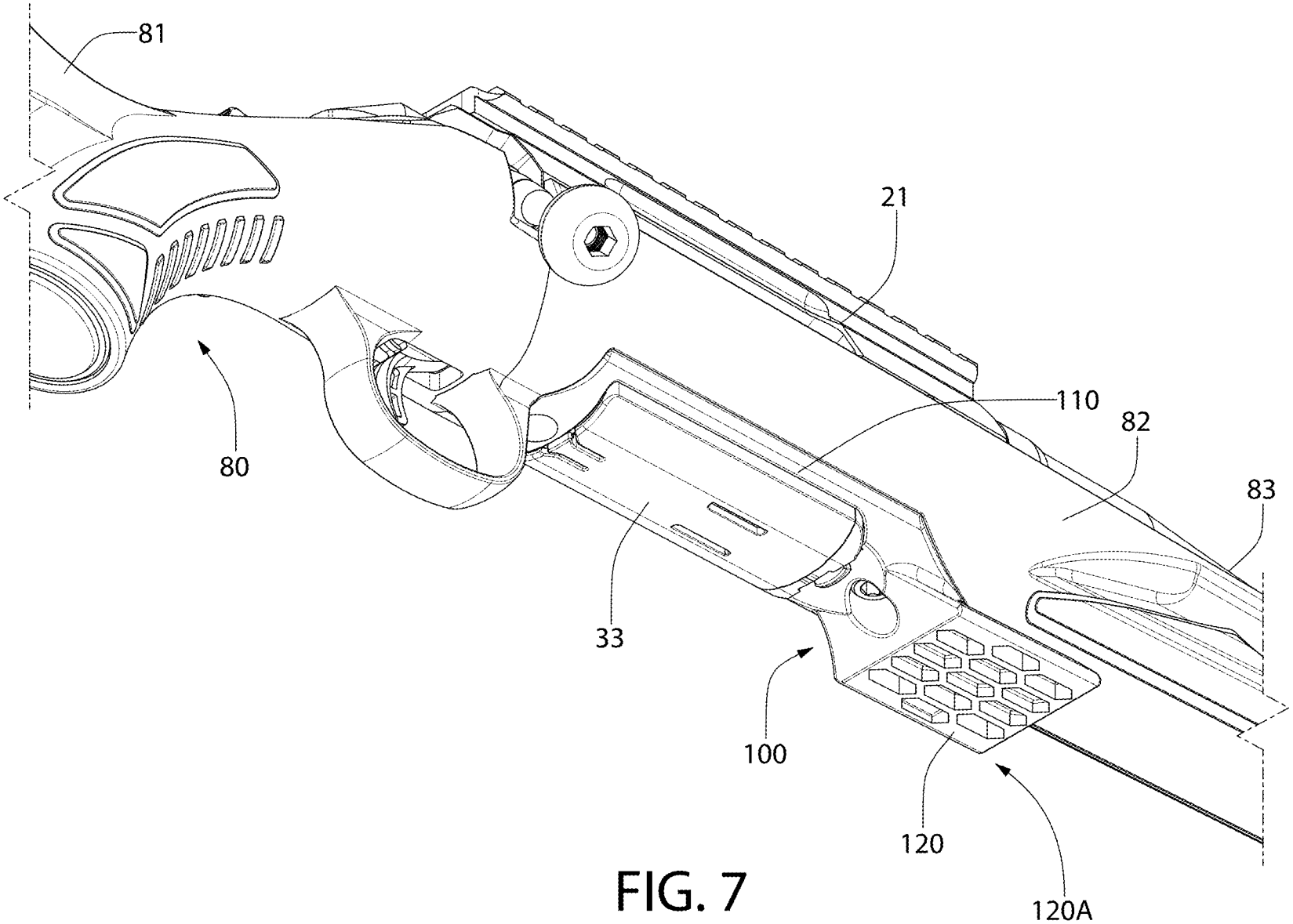
FIG. 7 is an enlarged view of the firearm taken from FIG. 5.
Figure 8:
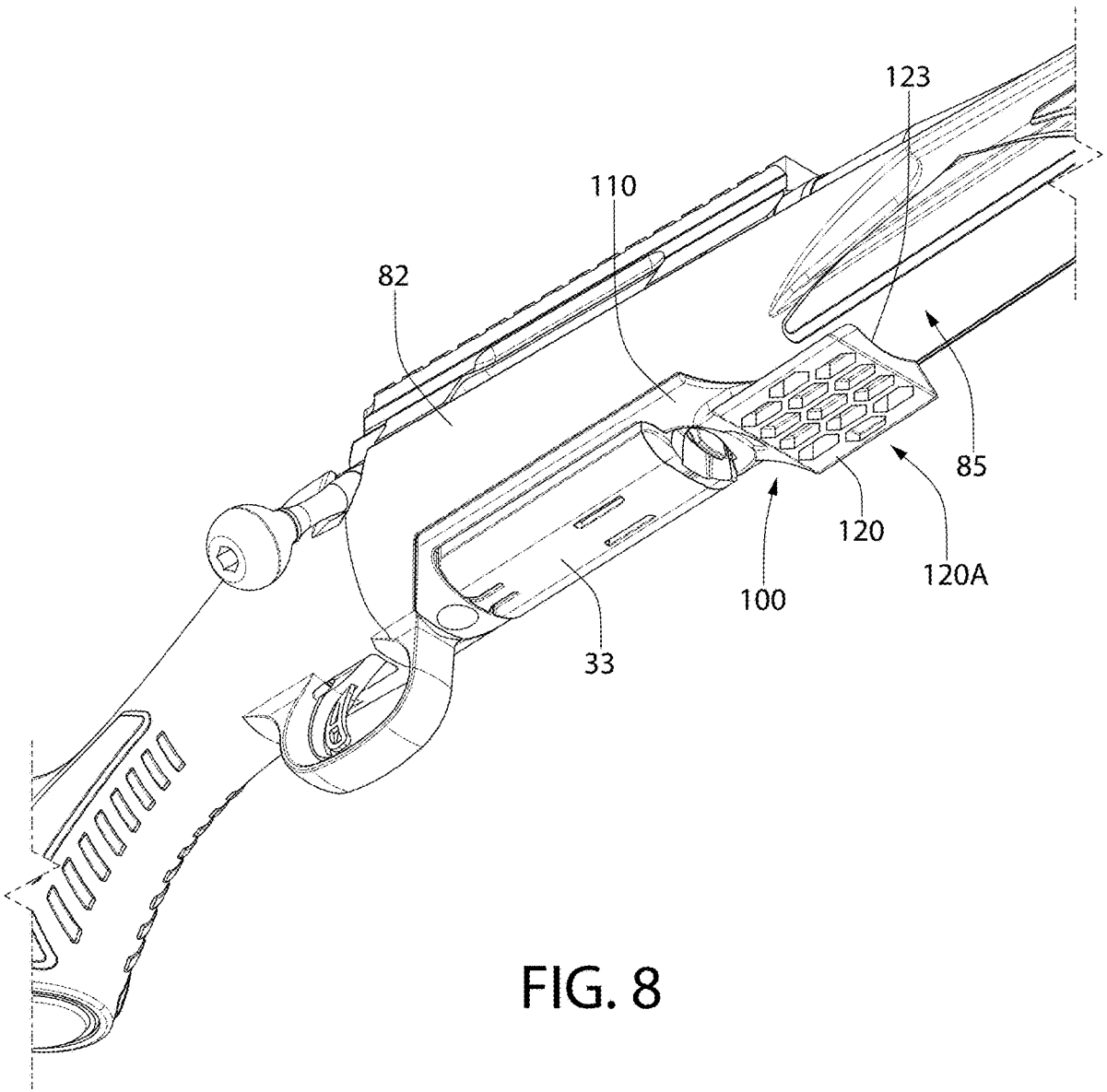
FIG. 8 is an enlarged view of the firearm taken from FIG. 6.

All drawings are schematic and not necessarily to scale. Parts shown and/or given a reference numerical designation in one figure may be considered to be the same parts where they appear in other figures without a numerical designation for brevity unless specifically labeled with a different part number and described herein.

DETAILED DESCRIPTION OF EMBODIMENTS

The features and benefits of the invention are illustrated and described herein by reference to preferred but non-limiting exemplary ("example") embodiments. This description of the embodiments is intended to be read in connection with the accompanying drawings, which are to be considered part of the entire written description. Accordingly, the invention expressly should not be limited to such embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

FIGS. 1-12 depict a magazine-fed firearm 20 suitable for detachably coupling a firearm support device or other firearm accessory thereto using an accessory rail mounting system according to the present disclosure. In one non-limiting embodiment, the firearm may be a long gun such as for example without limitation a rifle, carbine (i.e. rifle with shorter barrel), or a shotgun. Accordingly, the accessory mounting system broadly speaking is not limited in its applicability to any particular firearm accessory or firearm format alone in which it is desirable to mount an accessory to a firearm having a magazine feed. In the illustrated embodiment for convenience of describing the invention, the firearm may be but is not limited to a bolt action rifle such as the Ruger American Rifle available from Sturm, Ruger and Co., Inc. of Southport, Connecticut. Accordingly, in other embodiments the firearm may be an auto-loading semi-automatic rifle, carbine, or shotgun which are well known in the art without further explanation necessary.

Firearm 20 generally includes a longitudinal axis LA, stock 80, receiver 21 coupled to the stock, barrel 22 coupled to the receiver, bolt 50, and a trigger assembly 23 comprising a movable trigger 24 supported by the receiver. Each feature is further described below.

Barrel 22 has an elongated tubular body including an axial bore 37 extending longitudinally and axially from a rear breech end 38 to a front muzzle end 39 from which a projectile is discharged from the firearm. The centerline of bore 37 is coaxial with and defines the longitudinal axis LA of the firearm which extends completely through the barrel rearward through the receiver 21 (see, e.g., FIG. 9B). The rear breech end 38 of the barrel 22 defines a rearwardly open diametrically enlarged chamber 36 configured for holding an ammunition cartridge. Chamber 36 communicates with bore 37 which defines the projectile passageway for a bullet/slug or shot in the case of shotguns comprising multiple pellets encased by an outer shotgun shell.

Receiver 21 in one embodiment has an elongated body that defines an axially elongated longitudinal cavity 40 which carries and supports the movable bolt assembly 50. Internal cavity 40 extends along the longitudinal axis LA between an open front end 18 in communication with the barrel chamber 36 for loading cartridges therein and a rear end 19. Barrel 22 is coupled to the front end 18 of the receiver by any suitable means known in the art. In one non-limiting embodiment, the receiver 21 includes an axially elongated right ejection port 44 through which spent cartridge casings are ejected from the firearm after firing.

For convenience of assembly and maintenance/repair, the trigger-operated firing mechanism may be housed in trigger housing 23. Trigger housing 23 is detachably and removably mounted in stock 80. The trigger housing supports a pivotable sear 26 operably linked to the trigger 24. Sear 26 is configured and operable to hold the firing pin 30 in a rear cocked position and in turn release the firing pin forward to a fire position to strike a chambered cartridge via pulling trigger 24 in a conventional manner. Firing pin 30 is biased forward by firing pin spring 31 to which provides the force to strike a chambered cartridge held in the chamber 36 of the barrel 22 for discharging the firearm 20.

Bolt 50 has an axially elongated body and is slideably disposed in the internal passage 40 of receiver 21. Firing pin 30 is mounted in longitudinally-extending firing pin slot 30-1 formed in the bolt body. Bolt head 52 at the front of the bolt 50 defines radial bolt lugs 53 for forming a locked breach with mating barrel lugs (not shown) inside the rear breech end 38 of the barrel. The bolt head defines the vertical breech face that engages the breech end 38 of the barrel 22 adjacent to the cartridge chamber 36 when the breech is closed. Bolt 50 is manually movable via bolt handle 51 in the internal passage 40 of the receiver 21 along longitudinal axis LA between forward closed breech and rearward open breech positions. In the closed breech position, the bolt 50 is in battery with the rear breech end 38 of barrel 22 to close the chamber 36 for firing. In the open breech position, the bolt is axially displaced rearward to allow a spent cartridge casing to be ejected and for loading a fresh cartridge into the breech area of the receiver for chambering by the bolt when returned forward to the closed breech position.

The bolt handle 51 is fixedly coupled to the body of bolt 50 has a transversely elongated body configured for grasping by the user. The bolt handle is used by the user to both move the bolt axially between the open and closed breech positions, and to rotate the bolt between the locked and unlocked positions when the bolt is in battery with the barrel (closed breech position).

The firearm stock 80 is an axially (i.e. longitudinally) elongated structure which defines and includes sections such as generally defined in the art as the rear buttstock 81, mid-stock 82 to which the receiver 21 is mounted and which defines the magazine well cavity 32, and the fore-end 83 extending forward from the mid-stock for a portion of the length of the barrel 22. The fore-end (also known as fore-stock or forearm) is the forward portion of the stock which a user generally holds when aiming and firing the firearm. The rear buttstock is the rear portion which the user braces against their shoulder when aiming and firing. In one non-limiting embodiment, as illustrated, the stock may be a monolithic unitary structure in which the foregoing sections of the stock are formed as integral unitary parts thereof. In other embodiments, one or more of the sections may be formed separately from each other and then joined together by suitable mechanical fastening means.

The mid-stock 82 of stock 80 defines an upwardly open longitudinal passageway 84 which receives the receiver 21 at least partially therein when mounted to the stock. Stock 80 may be formed of wood and/or glass-filled polymer in some embodiments. Other materials may be used and does not limit the applicability of the invention.

Figure 9A:
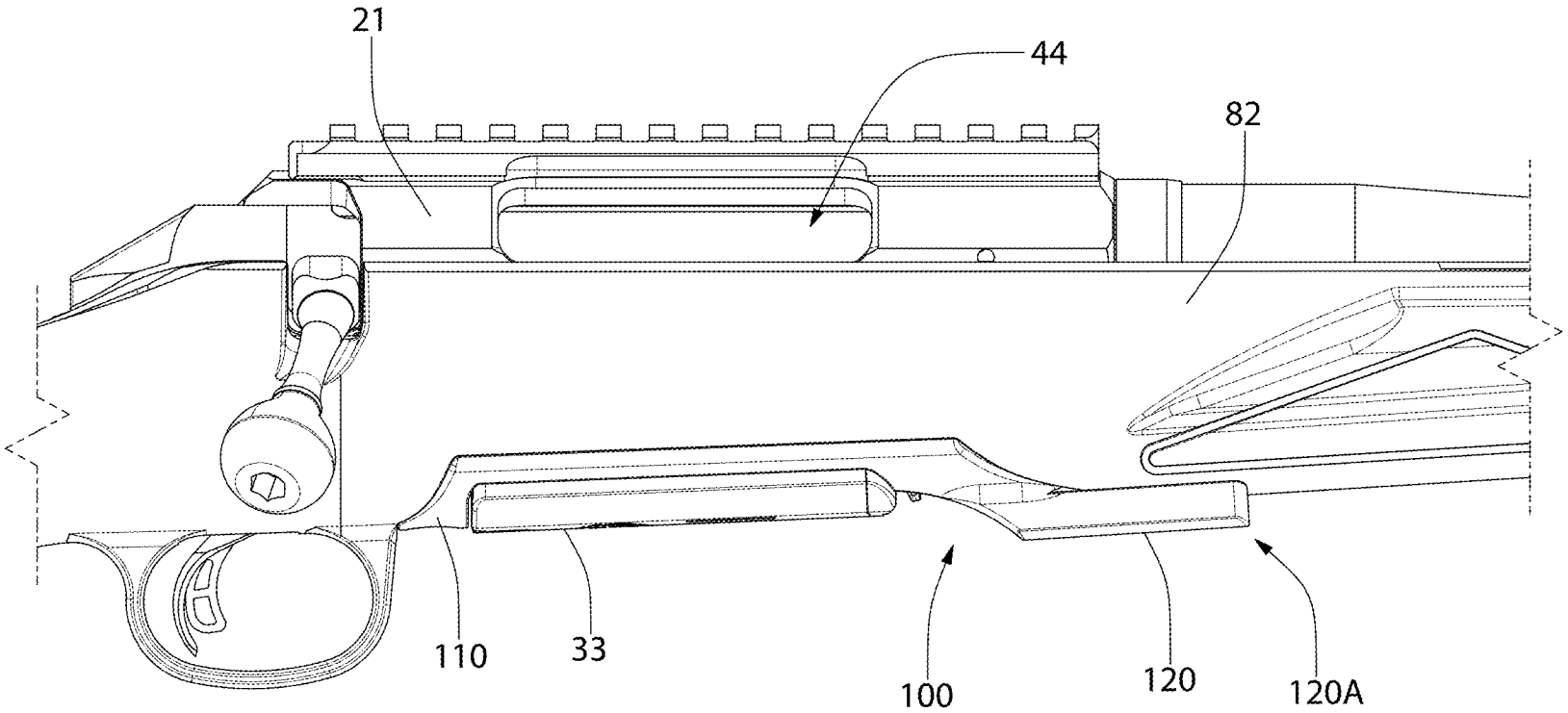
FIG. 9A is an enlarged side view of the firearm taken from FIG. 2.
Figure 9B:
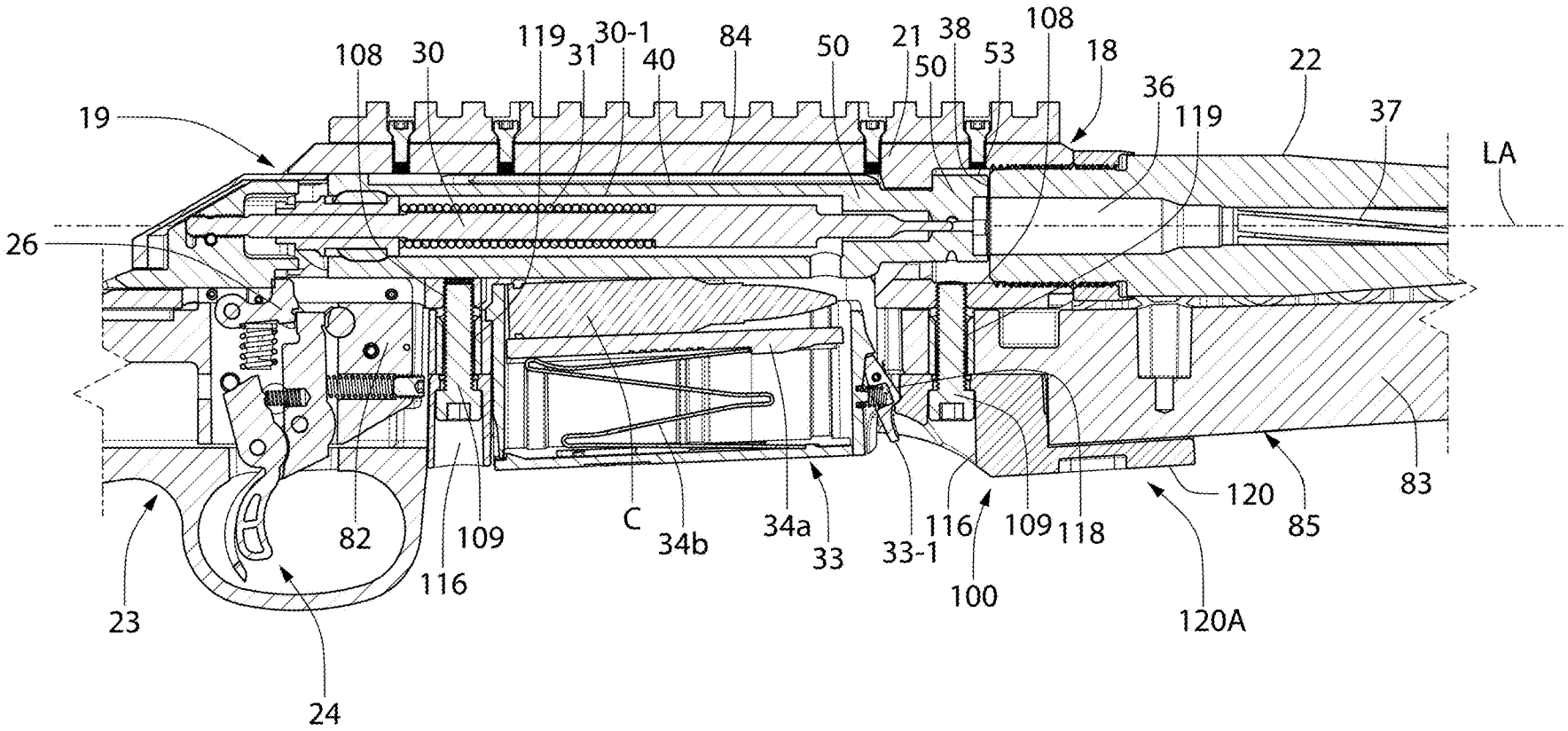
FIG. 9B is a cross sectional view thereof.
Figure 9C:
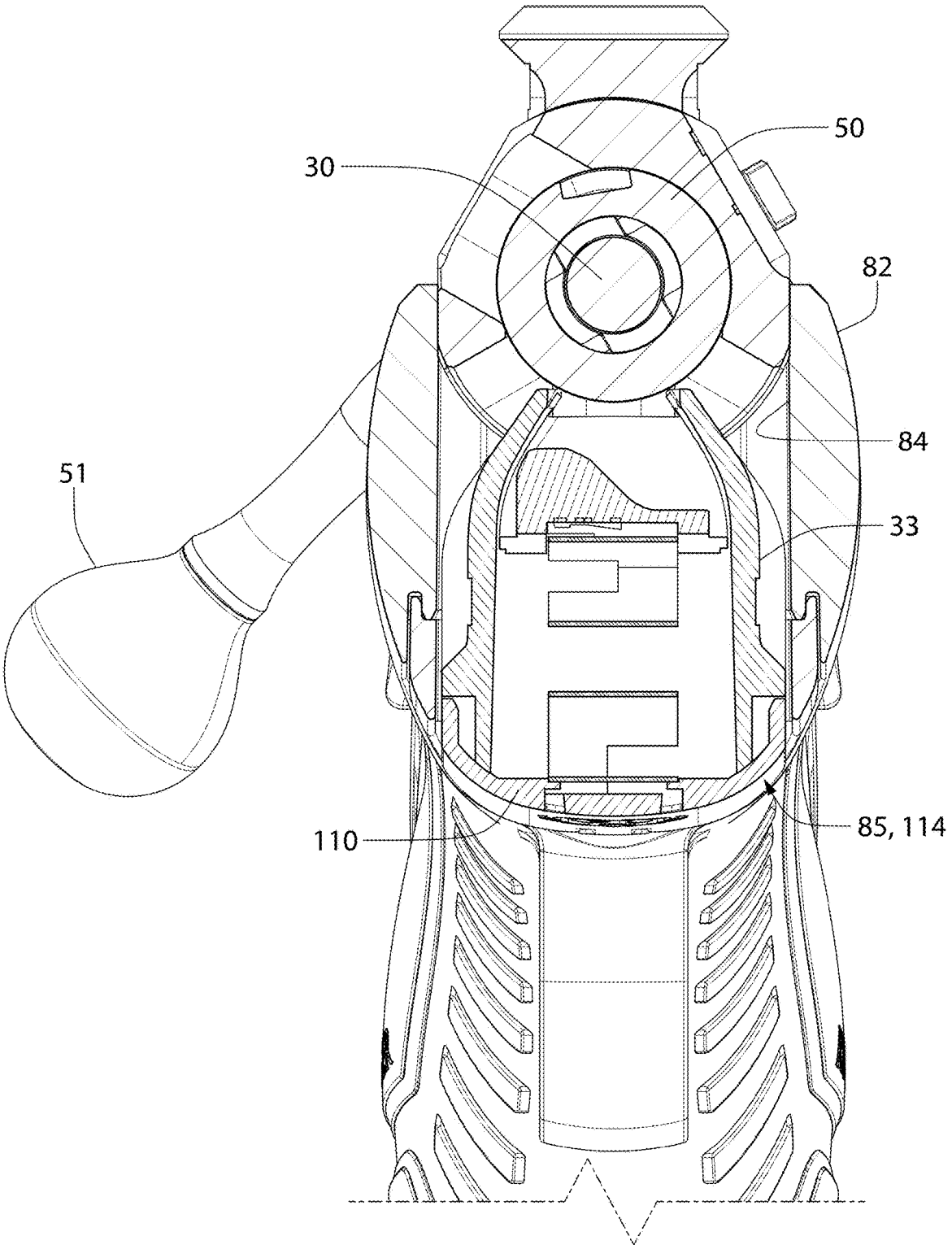
FIG. 9C is a first vertical cross-sectional view taken from FIG. 6.
Figure 9D:
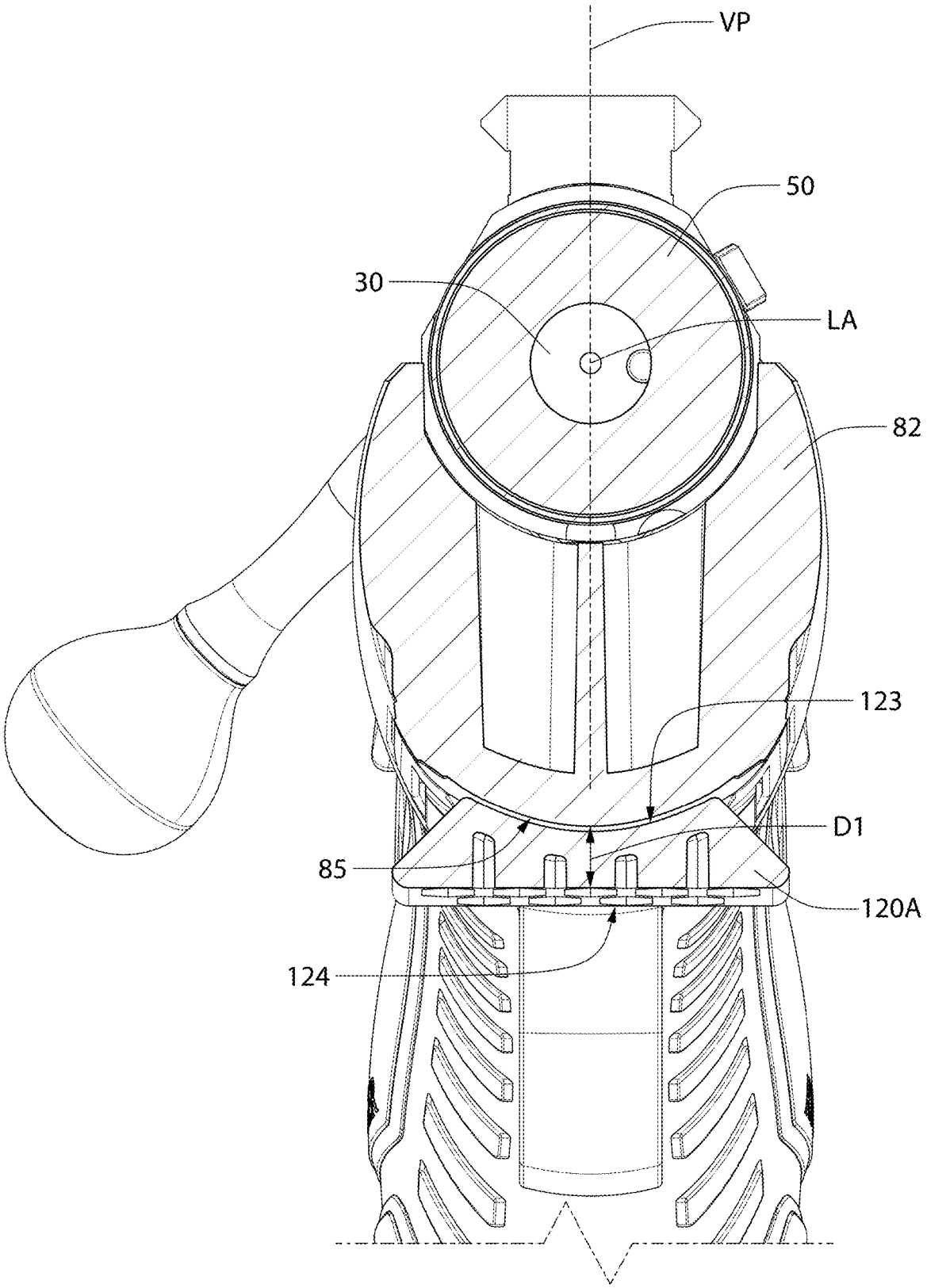
FIG. 9D is a second vertical cross sectional view taken from FIG. 6.
Figure 10:
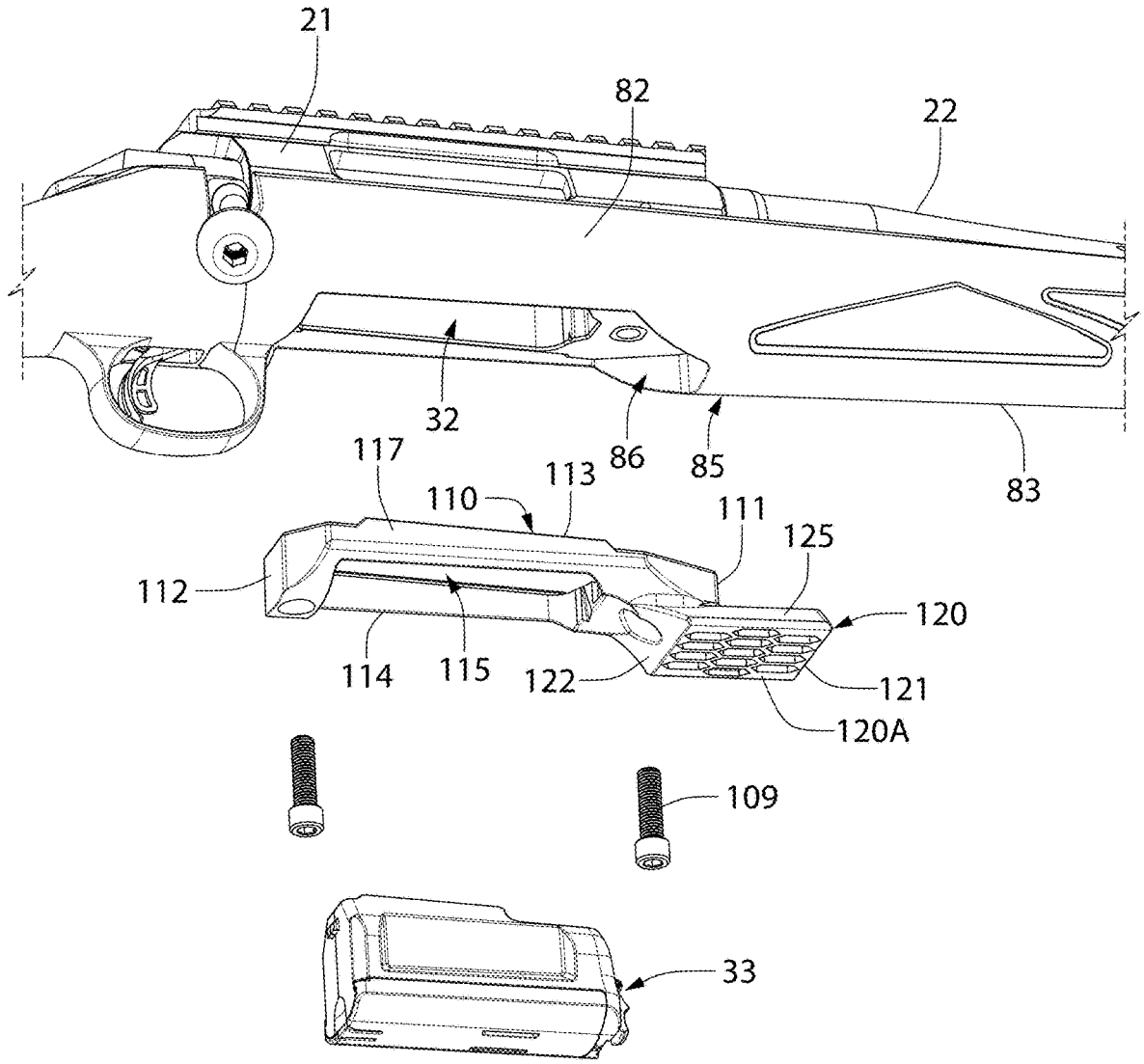
FIG. 10 is a bottom rear exploded perspective view of the mid-stock of the firearm.
Figure 11:
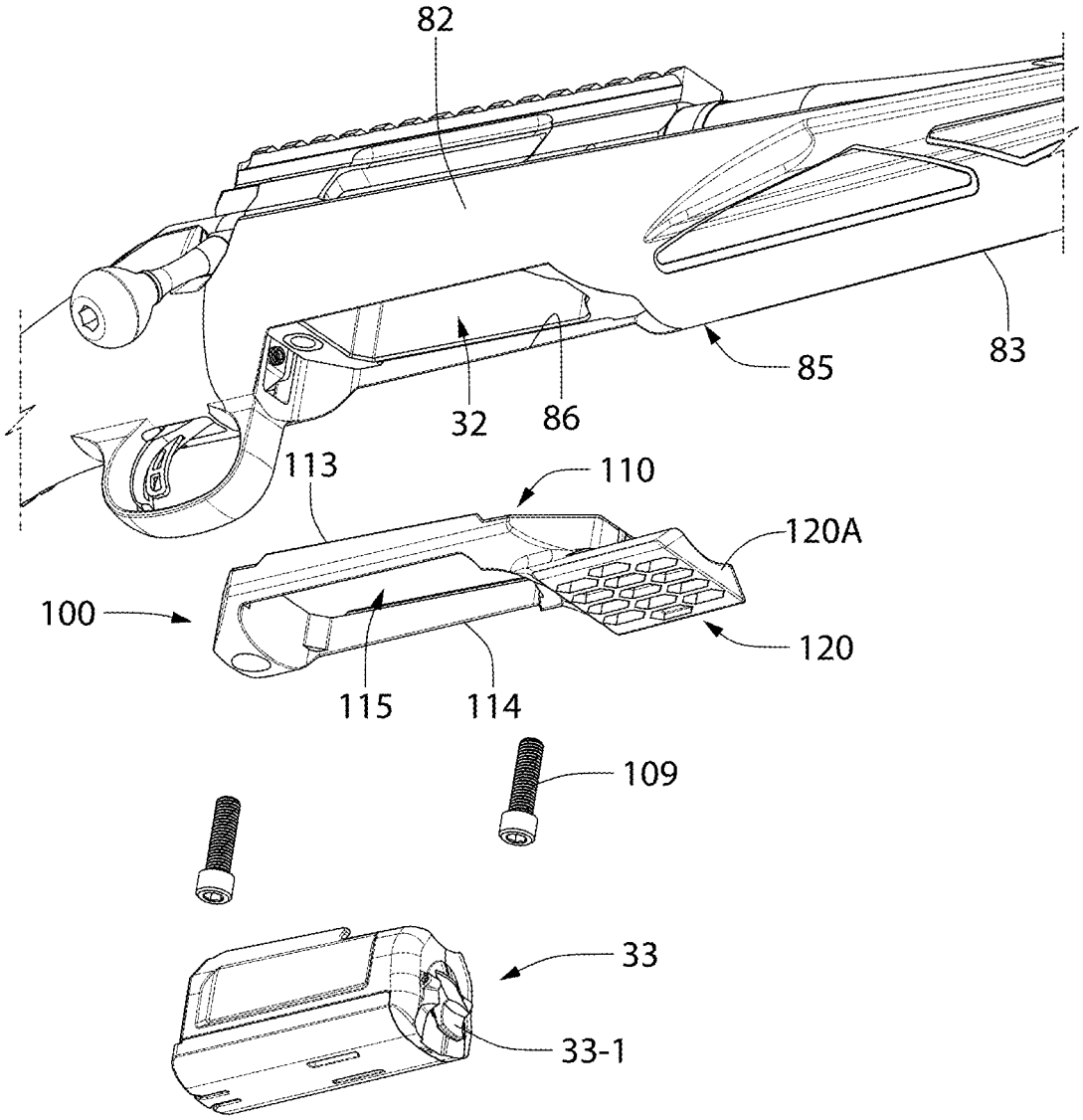
FIG. 11 is a bottom front exploded perspective view thereof.
Figure 12:
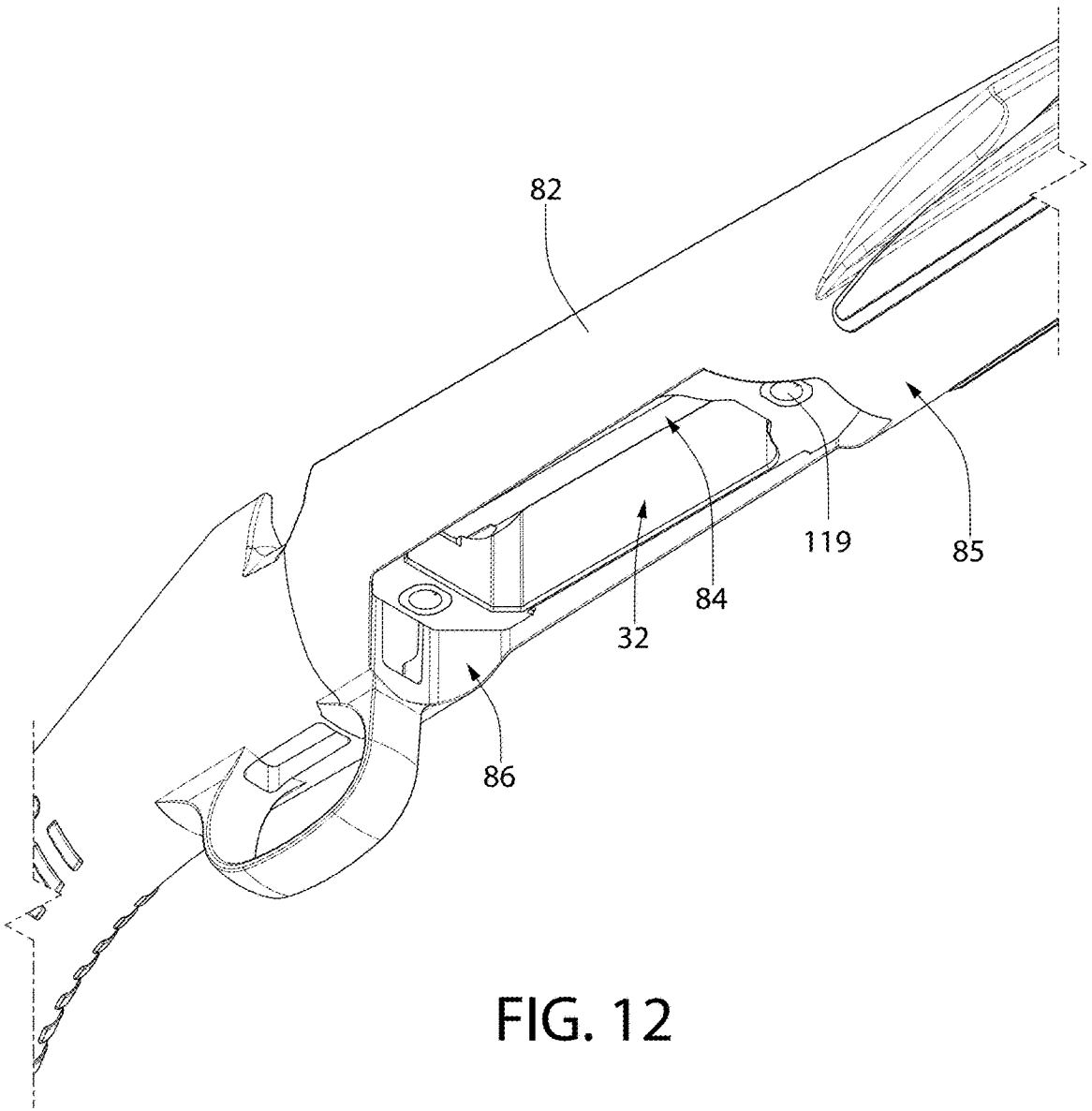
FIG. 12 is a bottom perspective view of the mid-stock alone showing a magazine well cavity of the stock with magazine well insert and magazine removed.
Figure 13:
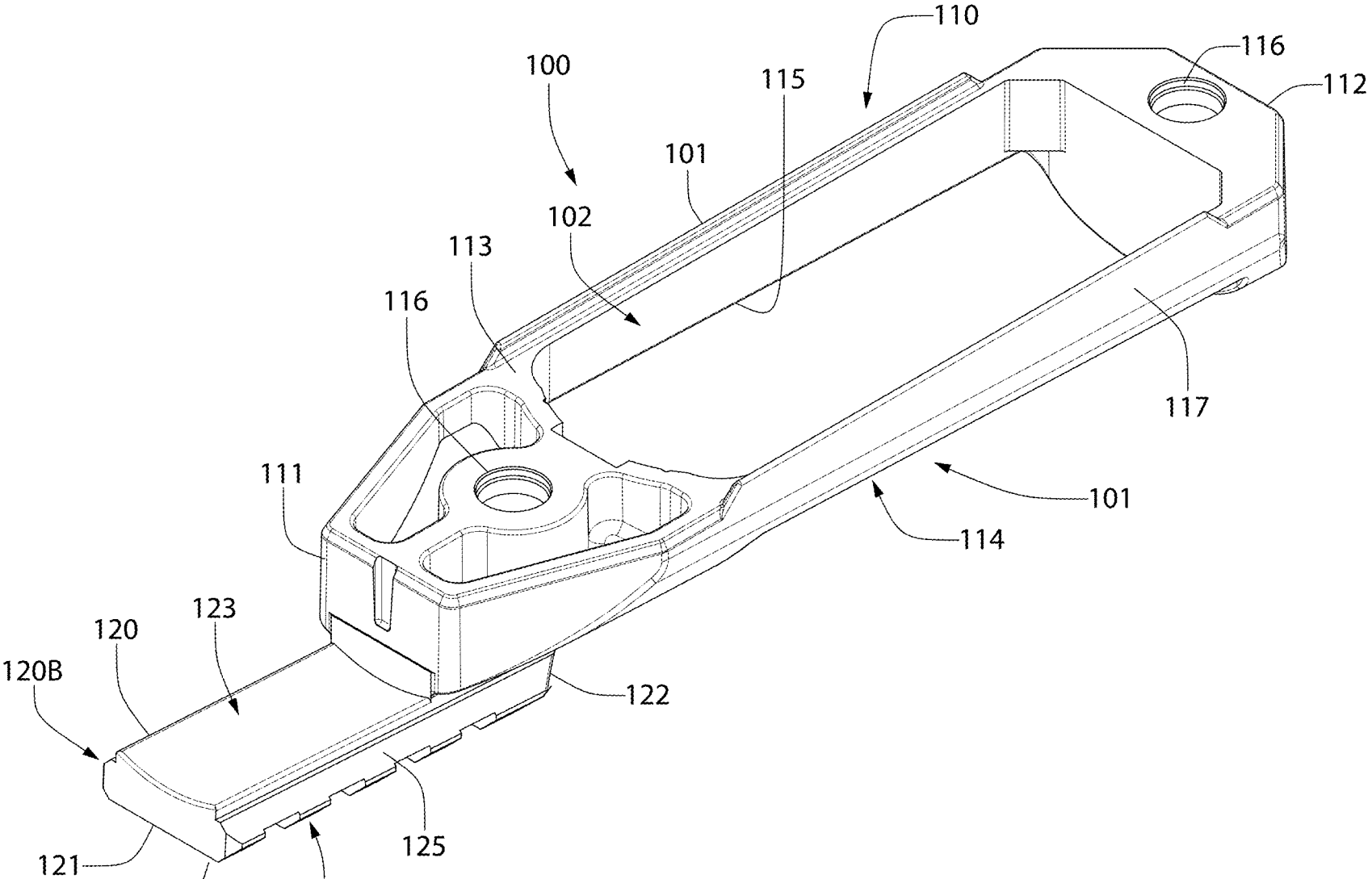
FIG. 13 is a top perspective view of a second embodiment of a magazine well insert according to the present disclosure with an accessory coupling rail in the form of a Picatinny rail.
Figure 14:
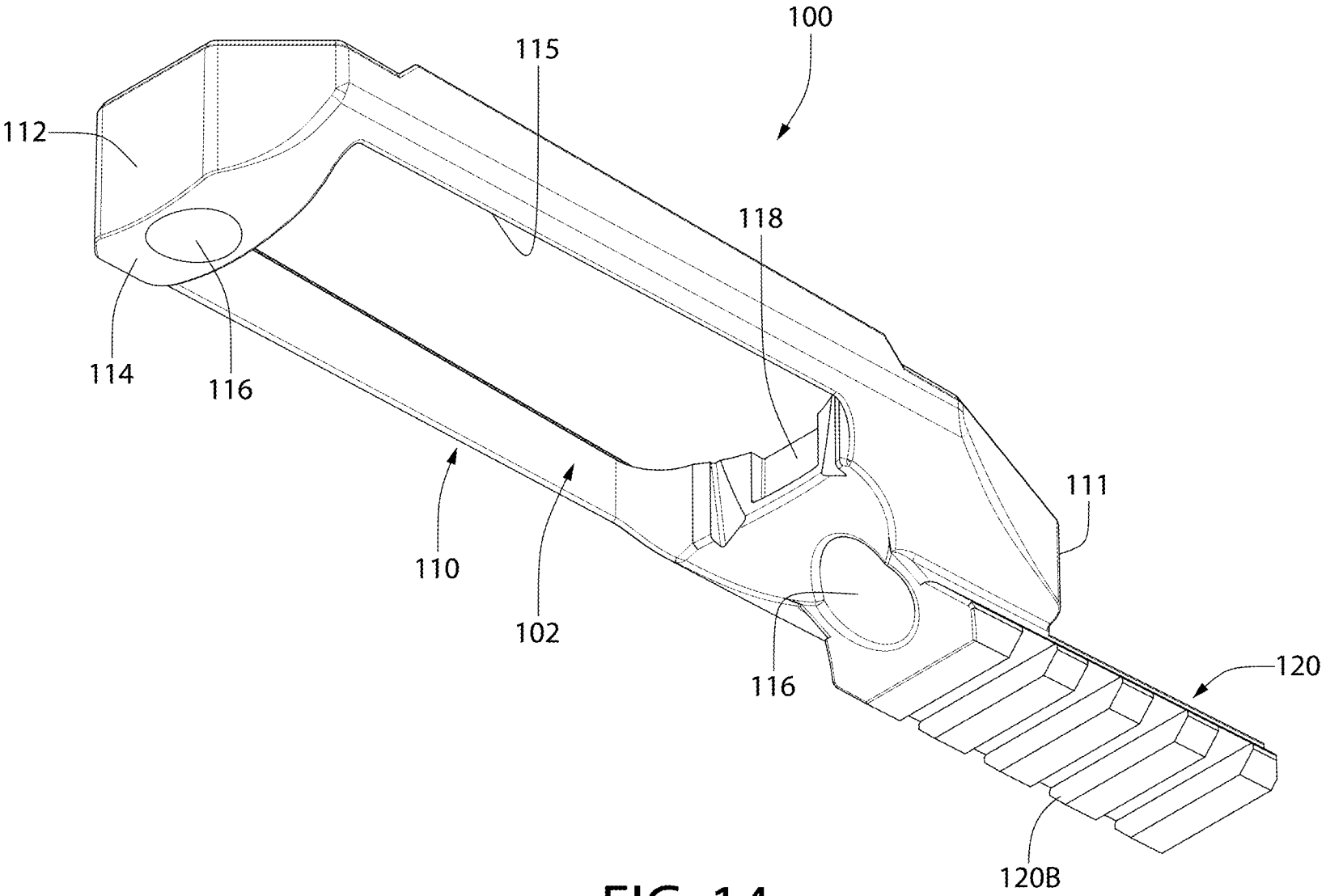
FIG. 14 is a bottom perspective view thereof.

The downwardly and upwardly open magazine well cavity 32 in communication with longitudinal passageway 84 is also defined by the mid-stock 82 (see, e.g., FIGS. 9B-C). Cavity 32 is terminated at the bottom surface 85 of the mid-stock 82 with an axially (i.e. longitudinally) elongated entrance recess 86 configured to receive the mounting portion 110 of a stock insert which is in the form of a magazine well insert 100 at least partially therein, as further described herein. The magazine well insert 100 according to the present disclosure which defines a magazine well 102 configured to releasably retain detachable ammunition magazine 33 which holds a plurality of cartridges. The magazines usable with magazine well insert 100 may a straight or curved box-style magazine (see, e.g., FIG. 9B), or a rotary magazine in various embodiments. Both box and rotary magazines are commercially-available and well known in the art without undue elaboration being necessary. The box style magazine contains a spring-biased stack of ammunition cartridges C that are uploaded into the breech area for chambering by the bolt 50 in a conventional manner each time the action is cycled in a conventional manner. As shown in FIG. 9B, the box style magazine 33 includes a follower 34*a* which supports the lowermost cartridge in the stack of vertical cartridges and which is biased upwards by magazine spring 34*b* in a conventional manner. Magazine 33 in some embodiments may be mounted in magazine well 102 of the insert 100 in a manner in which the bottom of the magazine is substantially flush with the bottom surface 85 of the mid-stock 82 (meaning no or minimal downward protrusion outwards therefrom).

According to one unique aspect of the invention, magazine well insert 100 includes a firearm accessory coupling rail 120 for detachably coupling a firearm accessory thereto such as a firearm support device like a bipod or tripod as some non-limiting examples. Magazine well insert 100 comprises an axially elongated body 101 including a mounting portion 110 and adjoining coupling rail 120 cantilevered from the mounting portion.

Coupling rail 120 of magazine well insert 100 may have various rail configurations commonly used in the art for mounting accessories to firearms such as long guns. As one example, FIGS. 1-11 variously depict a first embodiment of a magazine well insert with coupling rail 120 in the form of a dovetail rail which may be an ARCA rail designated 120A. ARCA rails are one specific type of generally trapezoidal-shaped dovetail rails (in cross-section) which are sometimes used in shooting competitions for attaching firearm support devices such as bipods and tripods to steady the long gun (e.g., rifles) for improved aiming accuracy. ARCA type dovetail rails have a 45 degree dovetail cut which interfaces with a mount of a clamping device of the accessory such as the bipod shown in FIGS. 22-23 further described herein. The ARCA rail has standardized dimensions which differ from other standard dovetail rails used for firearms of the same generally trapezoidal configuration but with different dimensions such as widths (the ARCA rail shown representing the same configuration as standard dovetail rails for disclosure purposes).

FIGS. 13-21 depict a second embodiment of a magazine well insert with coupling rail 120 in the form of a Picatinny rail designated 120B (also referred to as a tactical rail or MIL-STD-1913 rail). The U.S. government military standard MIL-STD-1913 controls the specifications of Picatinny rails. The Picatinny rail has a hexagonal cross-sectional shape with a plurality of longitudinally spaced-apart transverse cutouts 120B-1 spaced evenly and of specific dimensions specified by the military standard (see, e.g., FIG. 21). Standard dovetail rails including the ARCA rail do not have transverse cutouts.

Figure 25:
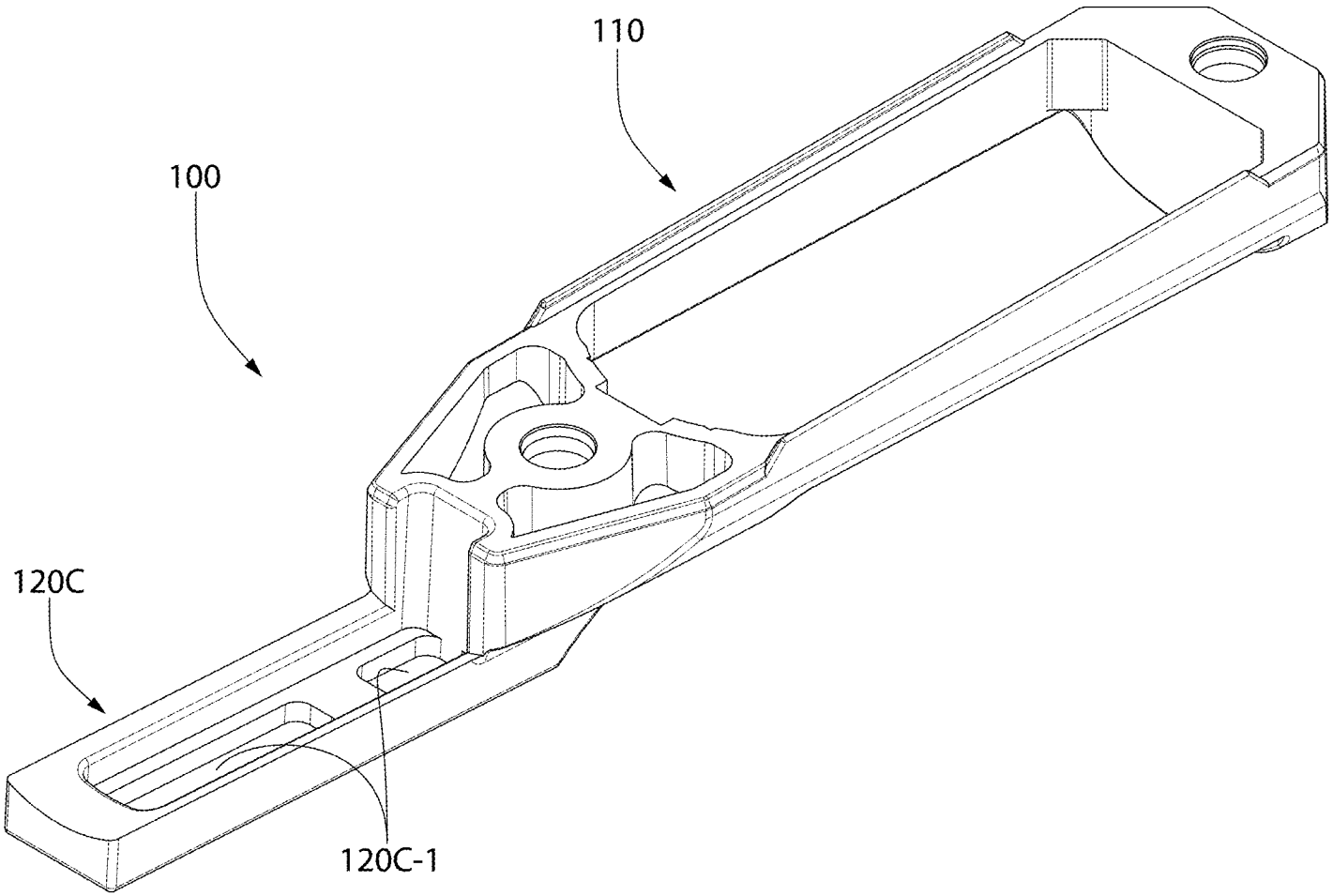
FIG. 25 is a top perspective view of a third embodiment of a magazine well insert according to the present disclosure with an accessory coupling rail in the form of an M-LOK® rail.
Figure 26:
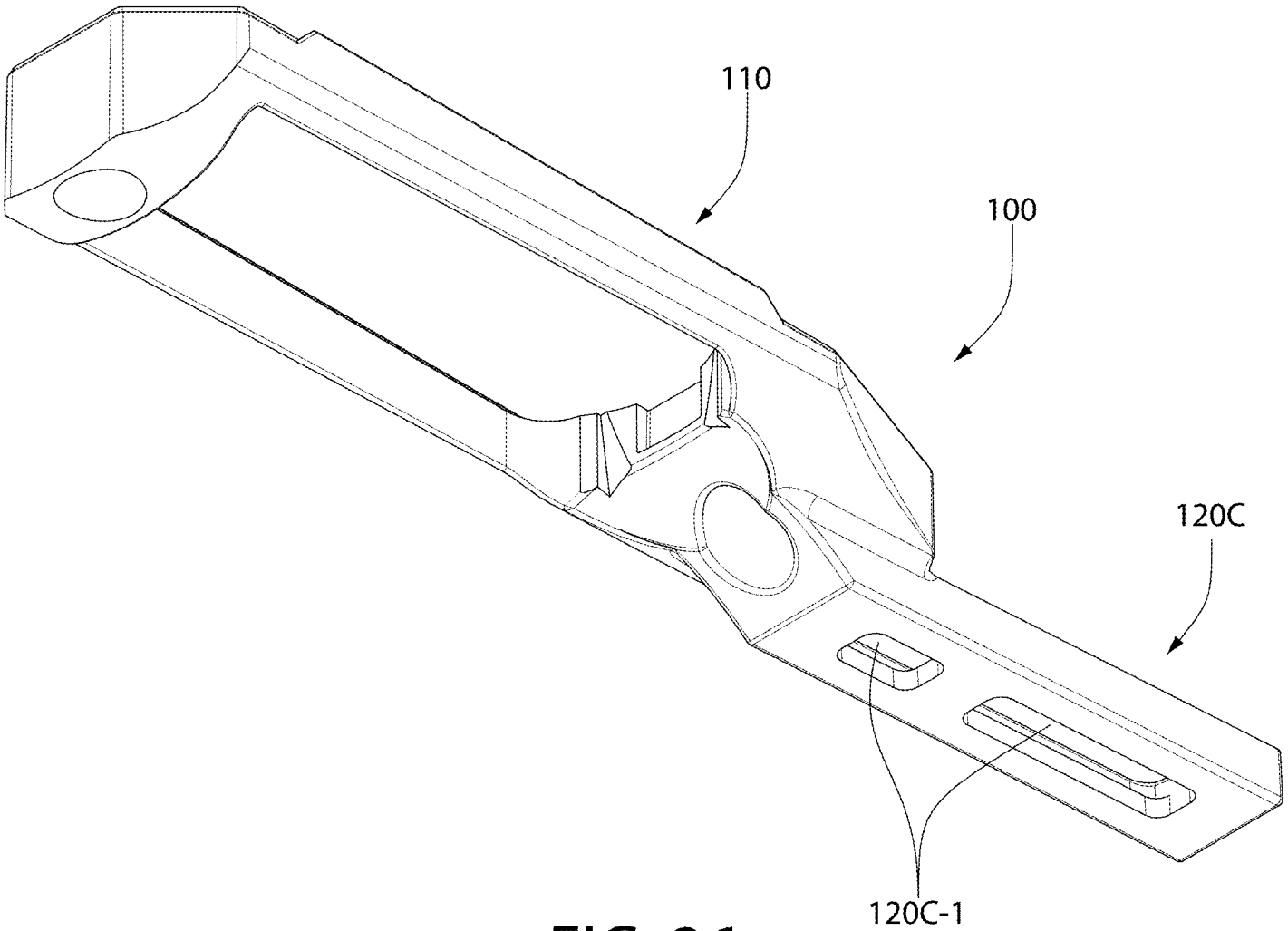
FIG. 26 is a bottom perspective view thereof.

FIGS. 25-26 depicts a third embodiment of a magazine well insert with yet another type of coupling rail 120 commonly used in the firearm arts which is an M-LOK® rail designated 120C. M-LOK® rails have longitudinal openings 120C-1 which define mounting locations for coupling accessories to the rails. The openings receive T-shaped nuts on the firearm accessory which are then rotated and locked in place on the rail.

It bears noting that although the coupling rail configurations may differ, the mounting portion 110 of the magazine well insert 100 may maintain the same configuration in some embodiments to interface with the mid-stock 82 of the firearm for mounting the insert thereto. In other embodiments, the configuration of the mounting portions 110 may be varied and combined with any of the firearm accessory coupling rail configurations disclosed herein in any combinations. Varying the configuration of the mounting portions may be used when the user wants to use a different type of magazine; the mounting portions each being configured to accept and latch a different type magazine thereto. Accordingly, in some embodiments a single coupling rail configuration may be provided with different configurations of mounting portions for the magazine well insert. In other embodiments, different coupling rail configurations may be provided with different mounting portions offering a multitude of potential rail and mounting portion combinations.

Mounting portion 110 of magazine well insert 100 includes a front end 111, rear end 112, pair of lateral sides 117 extending longitudinally between the front and rear ends, top 113, and bottom 114. A pair of axially spaced apart fastener mounting holes 116 are formed in the mounting portion 110 which receive threaded fasteners 109 such as cap screws or other type fasteners in some embodiments therethrough for coupling the magazine well insert 100 to the bottom surface 85 of mid-stock 82 within the entrance recess 86 at the bottom end of the magazine well cavity 32. Fasteners 109 in one embodiment may serve dual duty as "action screws" (term of art) used to couple the receiver 21 to the mid-stock 85 (see, e.g., FIG. 9B). Specifically, the mid-stock includes a pair of unthreaded bores 119 with open bottom ends located entirely within the entrance recess 86. This allows fasteners 109 to pass through bores 119 to engage mating threaded sockets 108 formed on the underside of the receiver 21. Tightening the fasteners draws the receiver, mid-stock, and magazine well insert 100 tightly together in a rigid manner. Fasteners 109 therefore couple both the magazine well insert 100 to the mid-stock and in turn the receiver to the mid-stock.

In one embodiment, at least one of the pair of mounting holes 116 (e.g., front one) may be formed at least partially through the coupling rail 120 of the magazine well insert 100. This provides rigidity to the magazine well coupling to the mid-stock which is advantageous particularly when the weight of firearm is supported from the coupling rail 120 when coupled to a bipod or tripod.

When coupled to the firearm mid-stock 82, the bottom 114 of the mounting portion 110 of the magazine well insert 100 may be substantially flush with the bottom surface 85 of the stock of the firearm in some embodiments (meaning that there is no or minimal protrusion therefrom). The bottom 114 of mounting portion 110 of the magazine well insert 100 may be arcuately curved from side to side as shown if needed to match a corresponding cross-sectional profile of mid-stock if curved (see, e.g., FIG. 9C), or the mounting portion may be flat if the bottom surface of the mid-stock is flat to maintain a substantially flush fit. Any other cross-sectional profile or shape of the bottom of mounting portion 110 may be provided for a flush fit depending on the shape of the stock of the firearm encountered. In other embodiments contemplated, the bottom of the magazine well insert mounting portion 110 may be designed to intentionally protrude downwards from the bottom surface 85 of the mid-stock 82 if a substantially flush fit is not desired.

The mounting portion 110 defines the magazine well 102 which is configured to releasably engage and retain the ammunition magazine 33. An elongated magazine aperture 115 is formed in the mounting portion which is as part of the magazine well insert 100. Aperture 115 is configured in shape and dimension to receive an ammunition magazine 33 therethrough to enter the magazine well and the magazine well cavity 32 of mid-stock 82 when the magazine well insert 100 is mounted to the stock. Magazine well 102 is configured to releasably receive and retain the magazine 33. A magazine latching feature such as latch surface 118 formed as a notch or depression within the magazine well 102 and magazine aperture 115 mates with a pivotable and spring-biased magazine latch lever 33-1 formed on the of the magazine to releasably retain the magazine in the well (see, e.g., FIG. 9B). In the illustrated embodiment, latch surface 118 is formed in the front of the magazine aperture 115 in mounting portion 110 of the magazine well insert and the latch lever 33-1 is correspondingly located on the front of the magazine 33.

It bears noting that other shaped magazine wells for the magazine well insert 100 and other types of latching mechanisms and arrangements may be provided for various box-style or rotary-style magazines described elsewhere herein. Accordingly, the configuration of the latching feature and location on the magazine well insert 100 may be varied to mate with the corresponding location and type of latch mechanism provided on the particular magazine to be retained in the insert. In addition, the configuration (dimensions and shape) of the mounting portion 110 and aperture 115 formed thereby of insert 100 can be customized to match the particular type and dimensions of the magazine to be retained. Accordingly, a plurality of different magazine well inserts each with a coupling rail but customized mounting portion may be provided. The only limitations are the configuration and dimensions of the magazine well cavity 32 and corresponding bottom entrance recess 86 defined by the stock 80 (i.e. mid-stock 82). The illustrated embodiment of magazine well insert and magazine is only one non-limiting example for purposes of description.

It further bears noting that the magazine well insert 100 with coupling rail 120 can be exchanged with the standard magazine well insert having a mounting portion with the same configuration, but lacking the coupling rail when a rail-mountable accessory is not needed to be mounted to the firearm. This provides the end user with the ability to select the well insert appropriate for the circumstances. The magazine well insert without coupling rail would typically be provided initially by the firearm manufacturer with optional inserts being available with various rail options for installation by the user when desired.

The cantilevered coupling rail 120 of magazine well insert 100 has an axially elongated and laterally broad body 126 defining a front end 121, rear end 122, pair of lateral sides 125 extending between the ends, a top surface 123, and bottom surface 124. The coupling rail in one embodiment extends both downwardly and forwardly from the front bottom of the mounting portion 110 of the magazine well insert 100. More specifically, the rear end portion of the rail extends downwards at the transition to the front end 111 of the insert mounting portion 110. Accordingly, the coupling rail 120 is vertically offset from the mounting portion of the magazine well insert forming stepped shoulder 127 between the front end 111 of mounting portion 110 and top surface 123 of the coupling rail 120. This offset allows the mounting portion of insert 100 to be partially nested within entrance recess 86 formed in the bottom of the firearm mid-stock 82 while providing clearance beneath the mid-stock forward of the recess to accommodate the coupling rail of magazine well insert 100.

The coupling rail 120 has a height defined at the midpoint of the rail between its lateral sides 117 so that the bottom surface 124 of coupling rail 120 is spaced a sufficient vertical distance D1 from the bottom surface 85 of the mid-stock 82 to provide sufficient clearance to slide the rail into the coupling mechanism of the firearm accessory such as without limitation a firearm support device 200 (e.g., bipod, tripod, or other), or another type accessory (e.g., flashlight, laser sight, vertical grip, rail sling mount for coupling a sling for carrying the firearm, etc.). These and other types of rail accessories mountable to the magazine well insert are well known in the art and commercially-available. Distance D1 is defined as lying in a longitudinally-extending vertical plane Vp which intersects the longitudinal axis LA of the firearm (see, e.g., FIG. 9D).

Figure 15:
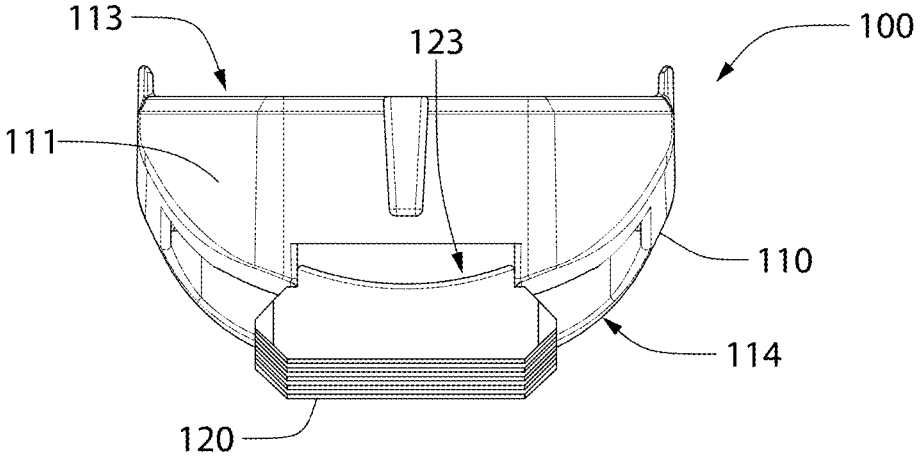
FIG. 15 is a front view thereof.
Figure 16:
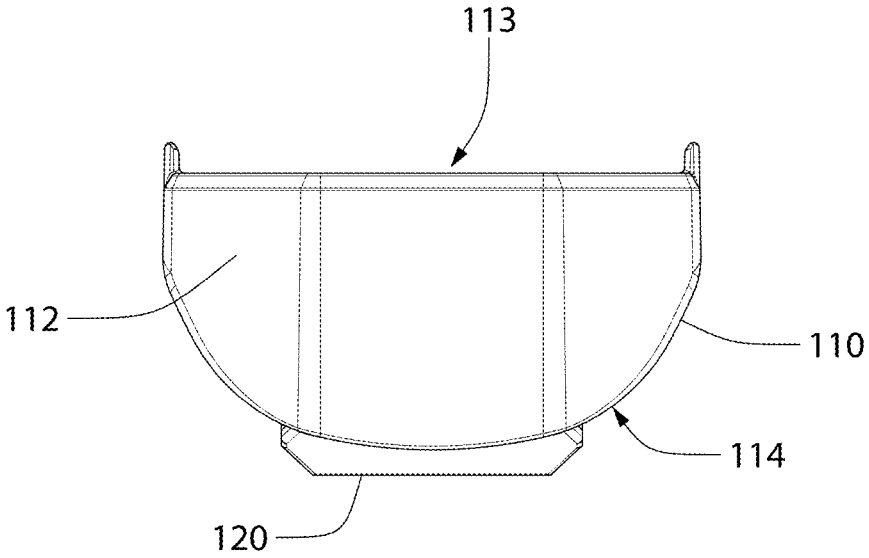
FIG. 16 is a rear view thereof.
Figure 17:
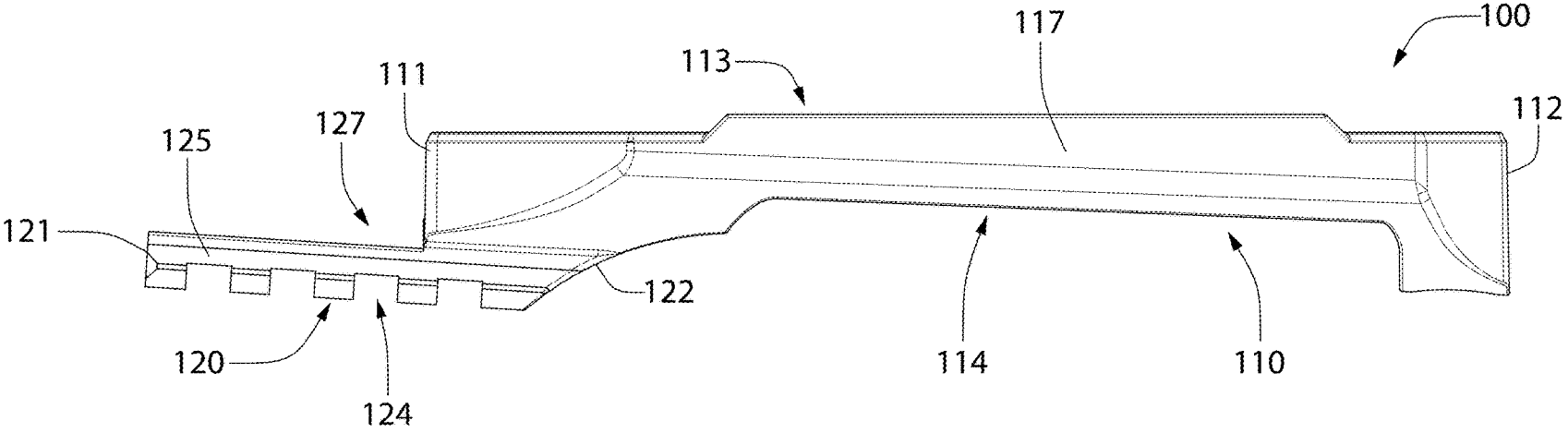
FIG. 17 is a left side view thereof.
Figure 18:
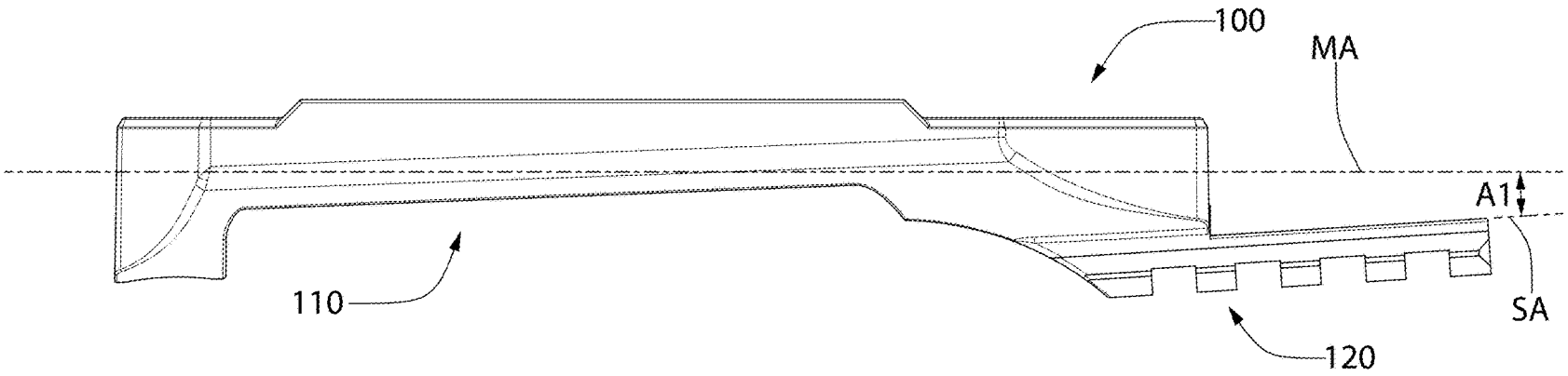
FIG. 18 is a right side view thereof.
Figure 19:
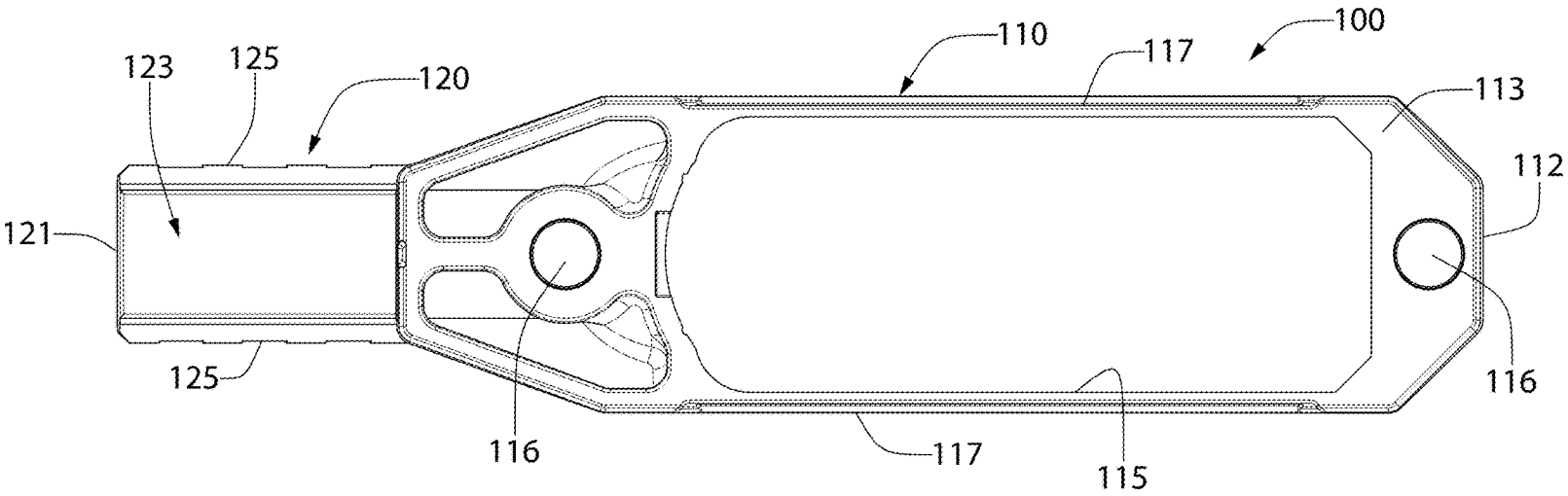
FIG. 19 is a top view thereof.
Figure 20:
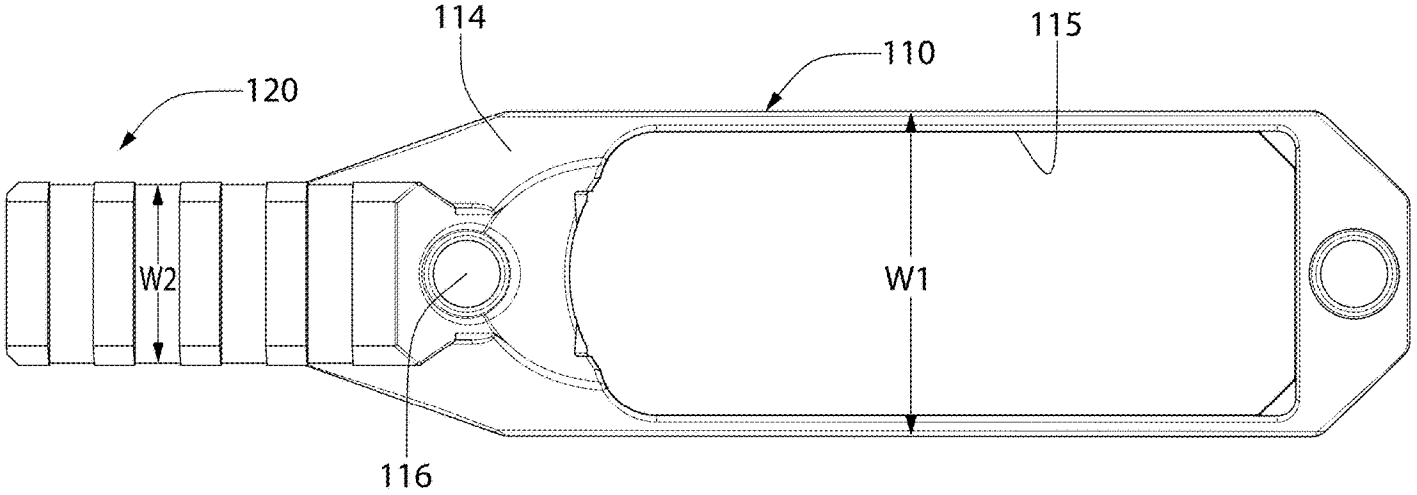
FIG. 20 is a bottom view thereof.
Figure 21:
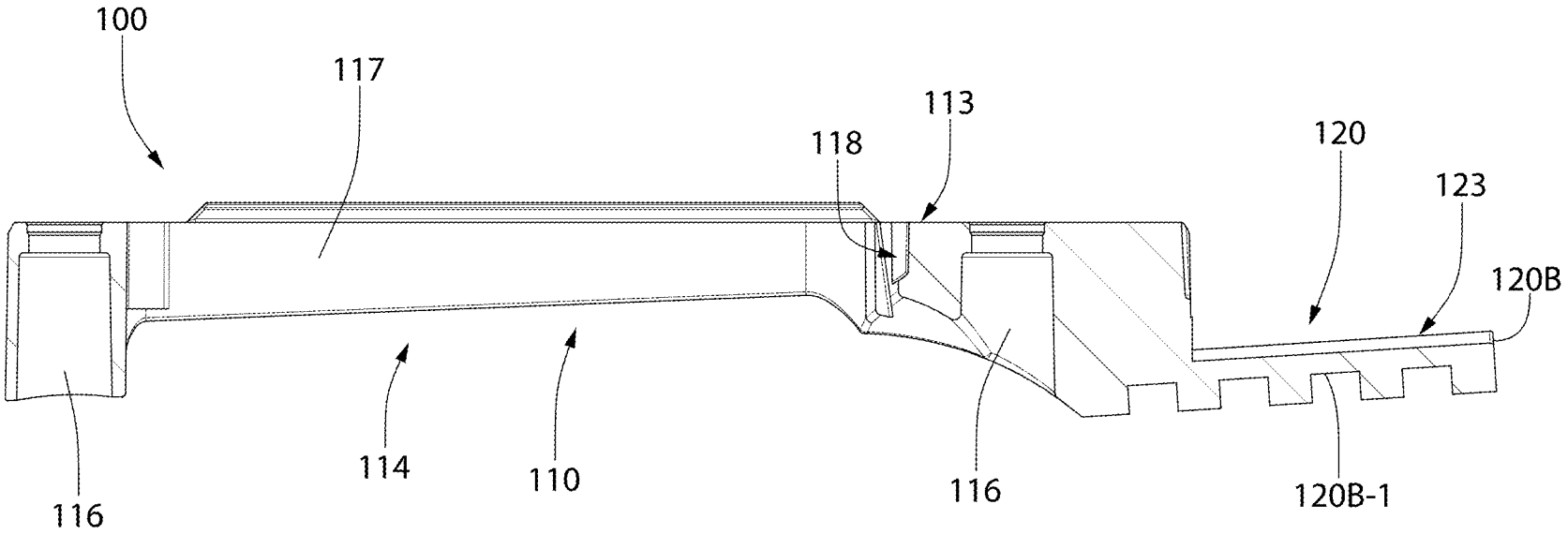
FIG. 21 is a side cross sectional view thereof.

In one non-limiting embodiment as illustrated, the coupling rail comprises an arcuately curved top surface 123 from side to side thereby defining an axially elongated concavity (see, e.g., FIG. 15). Concomitantly, the mid-stock 82 of the firearm stock in turn may comprise an arcuately curved bottom surface 85 from side to side. The curved bottom surface of the mid-stock is at least partially nested in the concavity of the rail when the magazine well insert 100 is coupled to the mid-stock (see, e.g., FIG. 9D). This advantageously allows close spacing of the rail to the mid-stock, and maintains an aesthetically pleasing appearance of the firearm.

The mounting portion 110 defines a horizontal mounting axis MA extending longitudinally between the front end 111 and a rear end 112 of the mounting portion. Mounting axis MA is equidistant between lateral sides 117 of the mounting portion. The coupling rail 120 defines a support axis SA extending longitudinally between the rear end 122 and a front end 121 of the coupling rail equidistant between the lateral sides 125 of the rail. The mounting axis and support axis are vertically offset from each other and lie in different horizontal planes. In one embodiment, the support axis SA may be disposed at an acute angle A1 to the mounting axis MA. In other embodiments, support axis SA may be parallel to mounting axis MA. Whether an actuate angle or parallel relationship between the axes is provided depends in part on the coupling interface of the firearm support device.

The body 102 of magazine well insert 100 in one embodiment may have a monolithic structure in which the mounting portion 110 and cantilevered coupling rail 120 are formed as integral unitary parts thereof. This not only simplifies manufacture, but provides an overall rigid structure that can support part of the weight of the firearm from coupling rail in a stable manner. The body including mounting portion 110 and coupling rail 120 may formed of a suitable metal and fabricated by any suitable metal fabrication method known in the art such as casting, forging, metal injection molding (MIM), or other as some examples. Suitable metals include steel, aluminum, titanium, or other metals. In other possible embodiments, a suitably rigid and wear-resistant non-metallic material such as a reinforced polymer may be used for the magazine well insert body.

Figure 24:
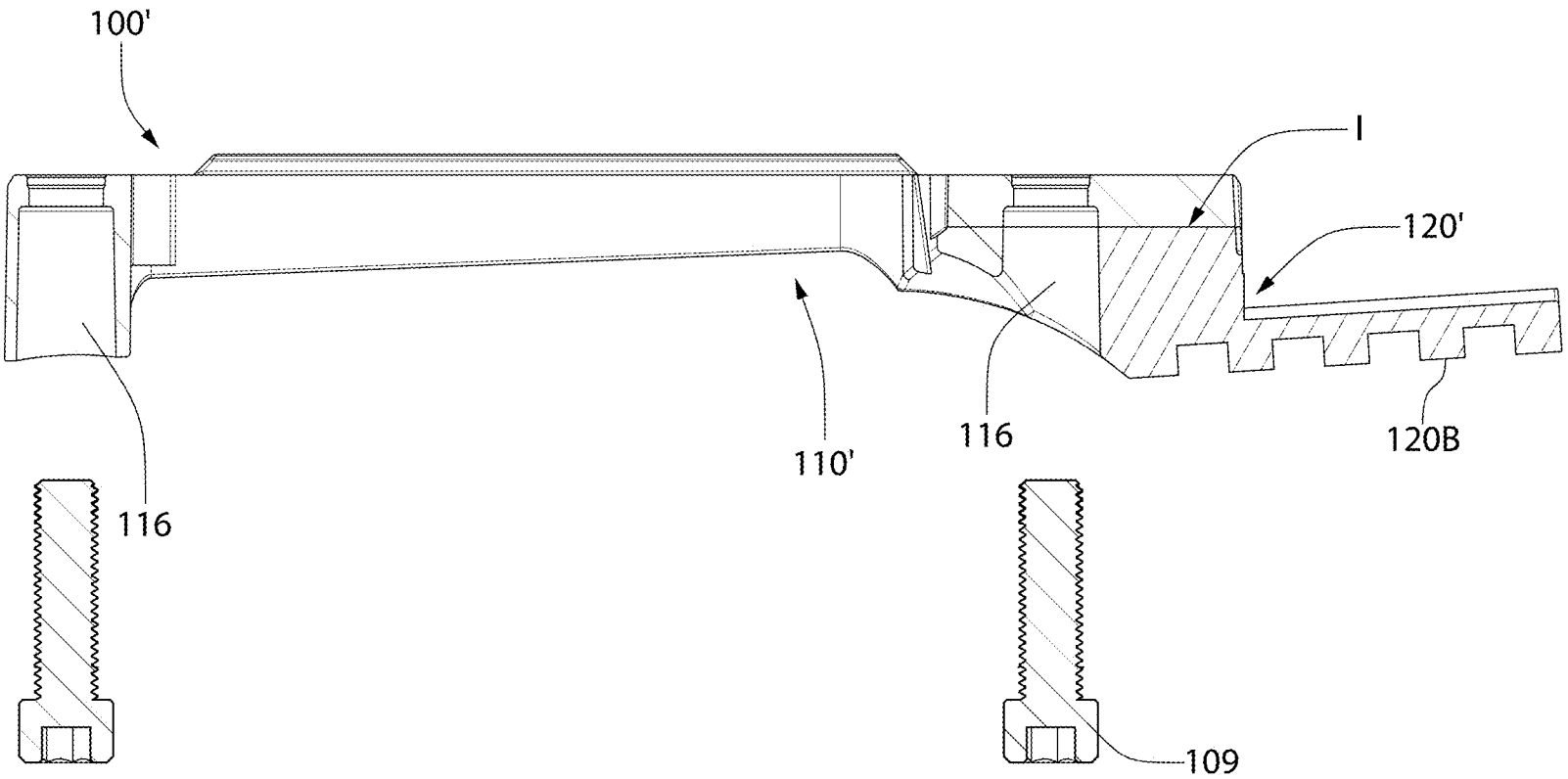
FIG. 24 is a side cross sectional view of the magazine well insert with coupling rail of FIGS. 13-21 showing a two-piece body in lieu of a monolithic body of the former figures.

In other possible embodiments, the metallic mounting portion and coupling rail formed by the foregoing metal fabrication methods may be provided as separate discrete components or parts which can be detachably mechanically fastened together. One possible non-limiting example of one such two-piece fabrication of a magazine well insert 100' is shown in FIG. 24. The interface "I" formed between the mounting portion 110' and coupling rail 120' appears as a solid line representing the demarcation between the two discrete components. The same fasteners 109 used to secure the mounting portion 110' to the mid-stock 82 can advantageously also be used to detachably couple the coupling rail 120' to the mounting portion (note forward fastener 109 shown extending through both the rear portion of the rail and forward portion of the mounting portion). This design provides the advantage that multiple different configurations/types of coupling rails 120 can be interchangeably used with the same magazine well insert 100 via a common mounting interface, thereby offering economies and versatility to allow the end user to readily swap coupling rail types and firearm support devices or other type accessories.

The cantilevered coupling rail 120 of the magazine well insert 100 is specially configured to provide a compatible coupling interface with the coupling mechanism and interface of the particular firearm accessory to be used, which can vary. For example, bipod and tripods used with firearms for hunting or competitive shooting matches may accept various types of accessory rail configurations. Accordingly, coupling rail 120 may be configured as a short section of various rails types including for example without limitation an ARCA rail (also used in photography), a Picatinny rail, M-LOK® rail, standard dovetail rail, and others. These rail types are well known in the art without undue further elaboration being necessary.

It bears noting that the detailed description above of the magazine well insert 100 with coupling rail 120 is applicable to all of the different configurations of coupling rails 120A, 120B, and 120C disclosed herein even though that description uses the Picatinny rail 120B of FIGS. 13-21 as a representative but non-limiting example except as noted.

Figure 22:
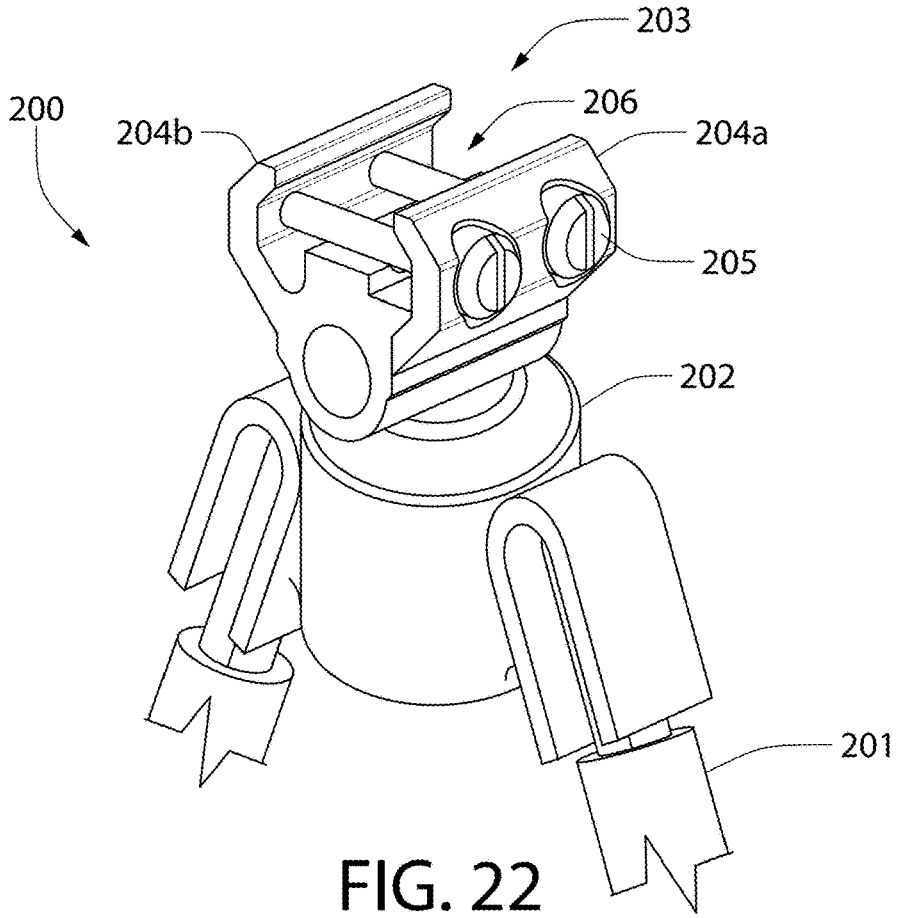
FIG. 22 is partial perspective view of a rail-mounted firearm accessory comprising a firearm support device in the form of an adjustable bipod usable with the magazine well inserts disclosed herein.
Figure 23:
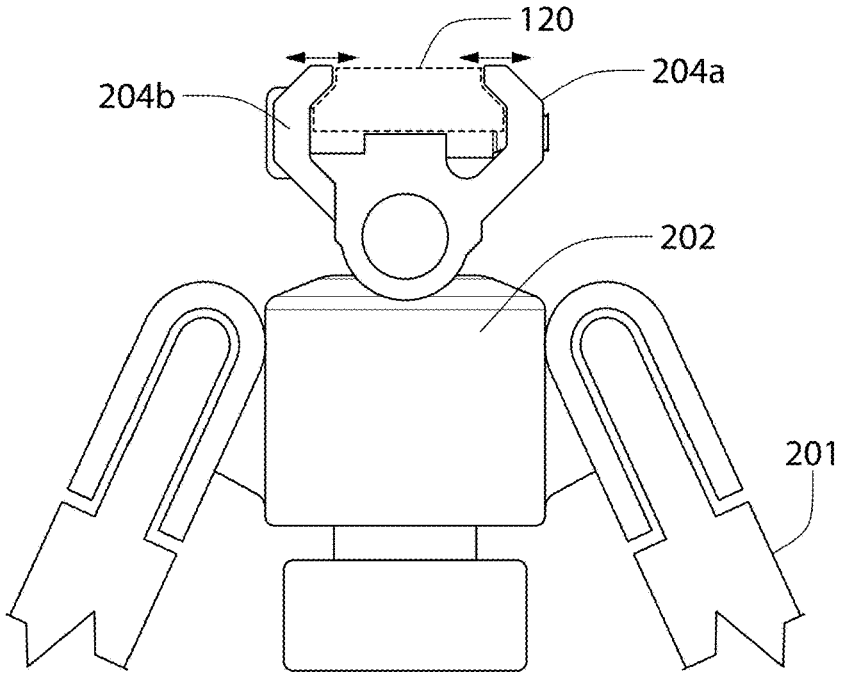
FIG. 23 is a front view thereof.

FIGS. 22-23 show one non-limiting example of a firearm support device comprising a bipod 200 for a firearm with a coupling mechanism and interface configured to mate with the coupling rail 120 of magazine well insert 100 described herein. Such bipods are commercially-available such as for example are available from Magpul Industries Corporation or other suppliers. Bipod 200 includes a pair of adjustable legs (spreadable and extendible/retractable) 201 which engage an available support surface to in turn support the firearm. The legs are coupled to a central swivel mechanism 202 which in turn includes rail coupling mechanism 203 including a pair of opposing jaws 204*a*, 204*b*. An adjustable opening 206 is formed by and between the jaws which is configured to receive and retain the coupling rail 120 of the magazine well insert 100 therein via a pressure clamping action. Jaws 204*a*, 204*b* are closeable and openable via rotating adjustment screws 205 which are coupled to each of the jaws. When and after the coupling rail is inserted into opening 206 with the jaws spread apart, the jaws may then be moved together to lockingly engage the rail via clamping action by tightening the screws to detachably couple the magazine well insert 100 and attached firearm to the bipod. Other clamping mechanisms may be used in other types of bipods, tripods, or other firearm support devices with the accessory coupling rails 120 disclosed herein, or with firearm accessories other than support devices examples of which have been described herein.

In addition to variations in types and designs of coupling rails that may be provided as already described herein, the mounting portion of the magazine well inserts may also vary in design and structure to match the type of ammunition magazine mounted in the stock. Various firearms may use different types of magazines other than those detachable box-type or rotary magazines which are completely removed from the firearm when empty and replaced with a fully loaded magazine (either the same one reloaded with cartridge or a second magazine). and magazines which remain in the stock such that new cartridges are manually loaded into the magazine without removing the magazine.

Figure 27:
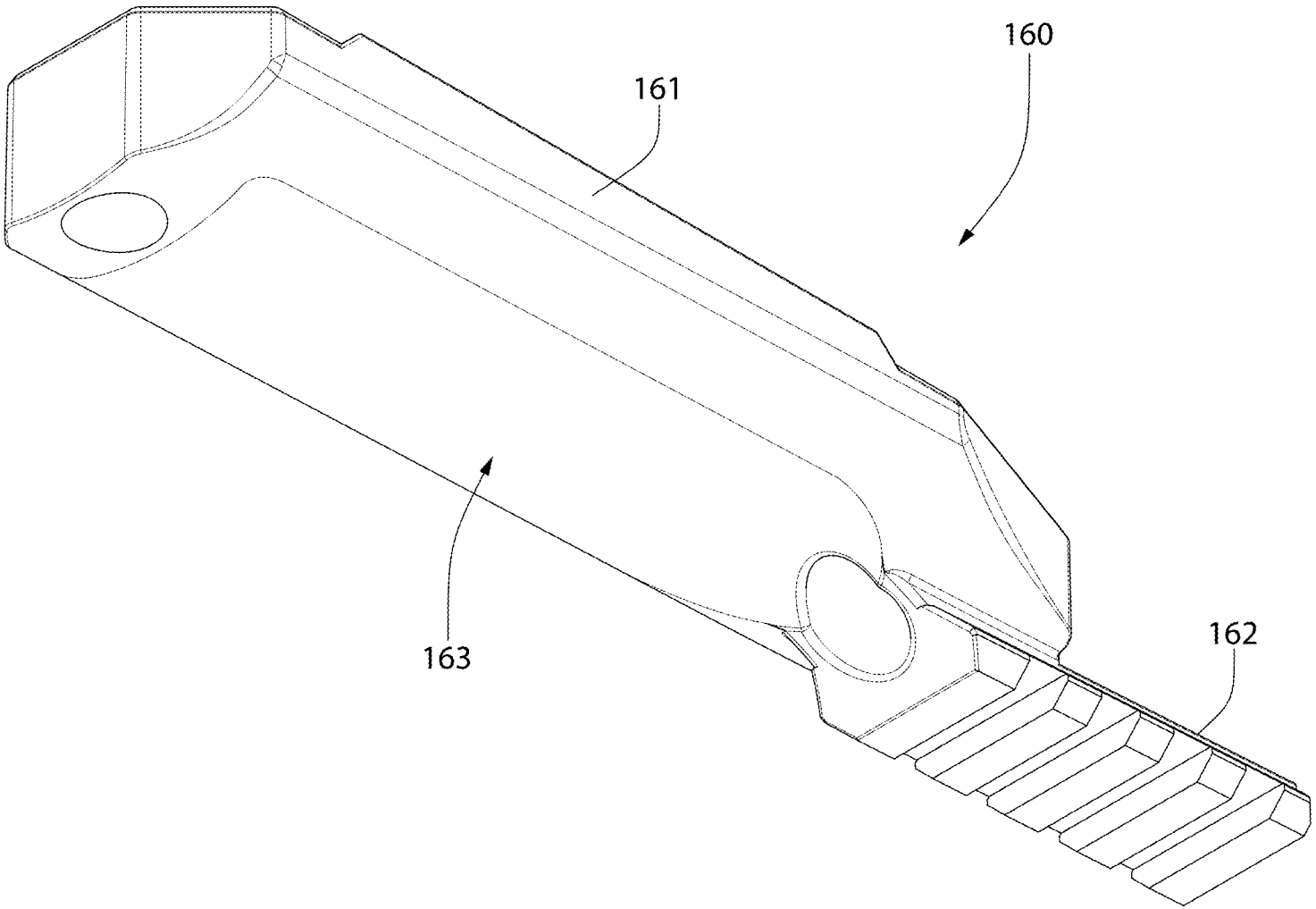
FIG. 27 is a bottom perspective view of a fourth embodiment of a magazine well insert according to the present disclosure.

FIG. 27 shows one embodiment of magazine well insert 160 having a mounting portion 161 and coupling rail 162 which can be configured as any of the coupling rail types disclosed herein or other. A section of Picatinny rail is shown for rail 162 as an example. Mounting portion 161 is configured similarly to mounting portion 110 previously described herein, but instead has a solid unremovable bottom surface which is not openable. There is no longitudinal aperture in the mounting portion 161. This type of magazine well insert may be used with firearms in which the magazine remains in the magazine well cavity 32 of the stock, and is loaded with cartridges through the top of the stock. Accordingly, the solid mounting portion 161 of present magazine well insert 160 serves to merely close the otherwise open bottom of the stock at the bottom of the magazine well cavity.

Figure 28:
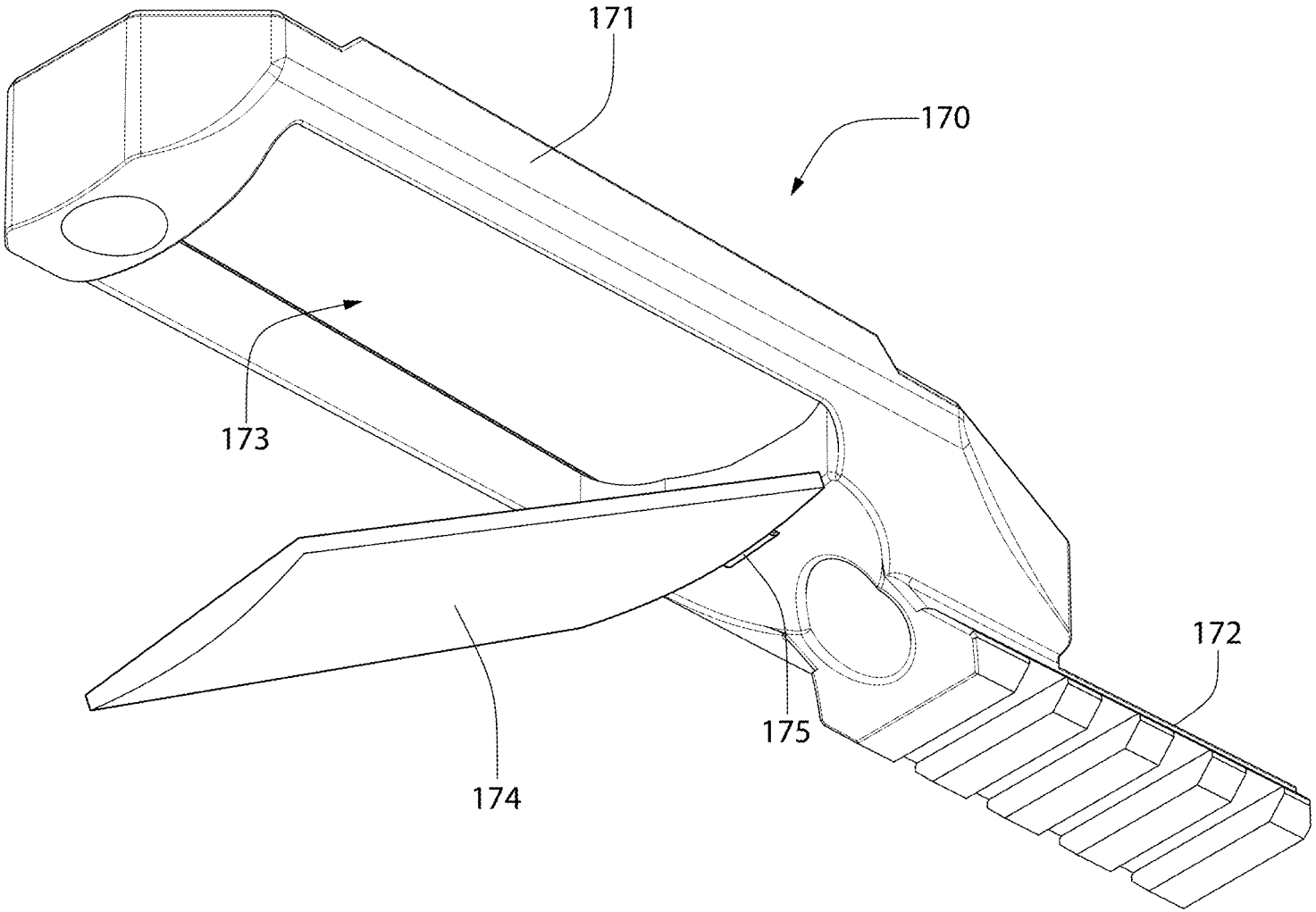
FIG. 28 is a bottom perspective view of a fifth embodiment of a magazine well insert according to the present disclosure.

FIG. 28 shows one embodiment of magazine well insert 170 having a mounting portion 171 and coupling rail 172 which can be configured as any of the coupling rail types disclosed herein or other. A section of Picatinny rail is also shown for rail 172 as an example. Mounting portion 171 is configured similarly to mounting portion 110 previously described herein, but instead has a pivotably openable/closeable hinged door 174 coupled to the mounting portion by hinge 175. Door 174 covers and fully encloses an elongated longitudinal opening 173 in mounting portion 171 when the door is in the closed position. This type of magazine well insert may be used with firearms in which the magazine remains in the magazine well cavity 32 of the stock, but is loaded instead from the bottom of the stock. Opening 173 is configured (e.g., shaped, structured, and sized) to insert cartridges therethrough into the stock and magazine. When door 174 is open, cartridges may therefore be loaded into the magazine through opening 173. The door is then closed for firing the firearm. A latching mechanism (not shown) may be provided to maintain the door in the closed position.

Figure 29:
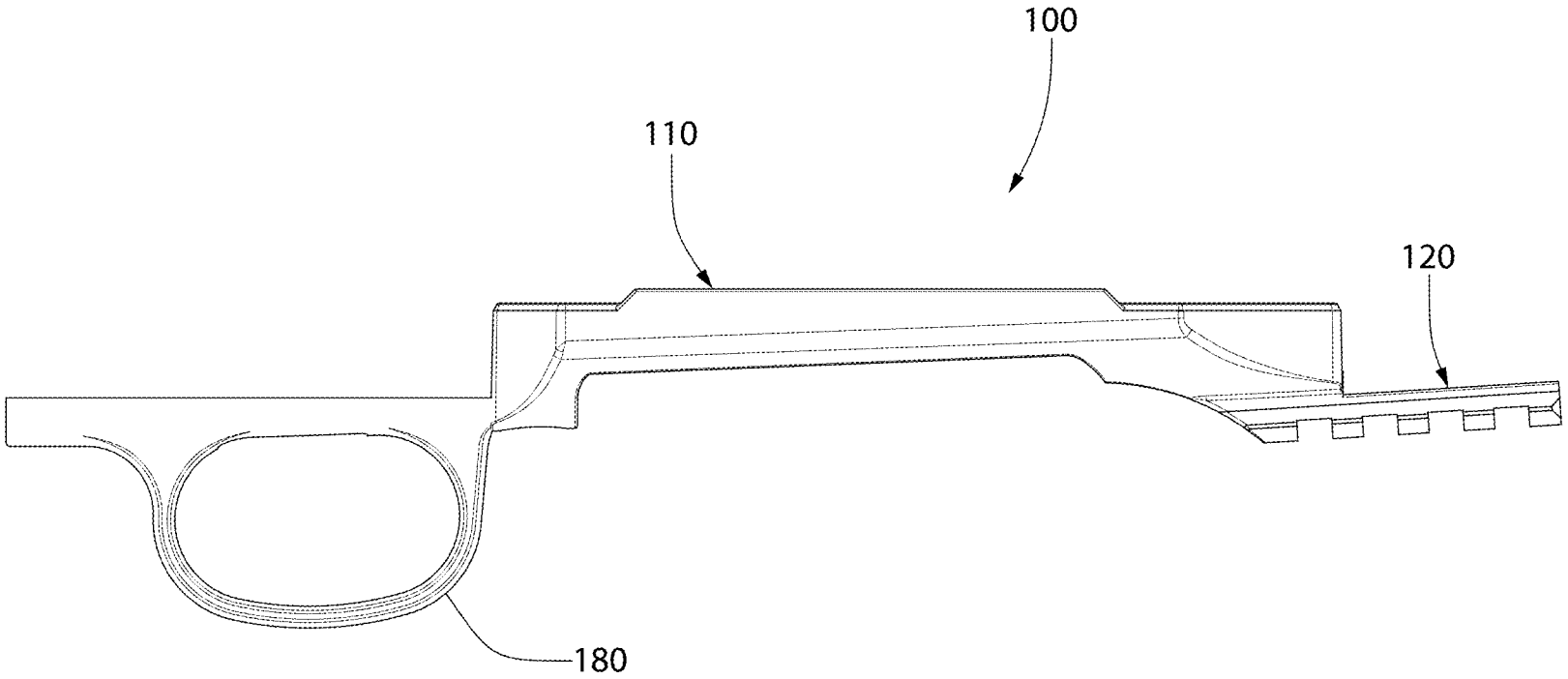
FIG. 29 is a side view of a sixth embodiment of a magazine well insert according to the present disclosure which includes a trigger guard.

In some embodiments as shown in FIG. 29, the magazine well insert 100 may optionally include a trigger guard 180. Trigger guard 180 projects rearward from the rear end of the mounting portion 110 of the insert whereas coupling rail 120 projects forward from the front end of the mounting portion. In some preferred but non-limiting embodiments, both the trigger guard 180 and coupling rail 120 may be formed as integral unitary parts of a monolithic structure which defines the magazine well insert. In other embodiments, the trigger guard may be a discrete separate part which is coupled to the rear end of the mounting portion 110 by any suitable coupling methods used in the art such as fasteners as one non-limiting example.

It will be appreciated by those skilled in the art that the stock insert and accessory rail mounting system disclosed herein is highly customizable and adaptable to meeting the differing needs and preferences of the firearm user and manufacturer.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. An accessory rail mounting system for a firearm comprising:

a longitudinal axis;

an elongated stock defining a downwardly open magazine well cavity;

a stock insert comprising a longitudinally elongated body including a mounting portion configured for detachable mounting to a bottom surface of the stock at the magazine well cavity, and an elongated coupling rail cantilevered from the mounting portion;

the coupling rail being configured to detachably couple a firearm accessory thereto;

wherein the coupling rail extends forwardly from the mounting portion of the stock insert; and wherein the coupling rail comprises an arcuately curved top surface defining an axially elongated concavity, the stock comprising an arcuately curved bottom surface which is at least partially nested in the concavity.

2. The mounting system according to claim 1, wherein a rear end of the coupling rail is vertically offset from the mounting portion of the stock insert forming a shoulder therebetween.

3. The mounting system according to claim 2, wherein the mounting portion defines a horizontal mounting axis extending between a front end and a rear end of the mounting portion, and the coupling rail defines a support axis extending between a rear end and a front end of the coupling rail, the mounting axis and support axis being vertically offset from each other.

4. The mounting system according to claim 3, wherein the support axis is disposed at an acute angle to the mounting axis.

5. The mounting system according to claim 1, wherein the stock insert is a magazine well insert, the mounting portion including a longitudinally elongated magazine aperture configured to receive an ammunition magazine therein.

6. The mounting system according to claim 5, wherein the stock insert includes a magazine latching feature configured to releasably engage a latch lever of the magazine which is operable to retain the magazine in the stock insert.

7. The mounting system according to claim 1, wherein a bottom portion of magazine well cavity of the stock comprises an axially elongated entrance recess formed in the bottom surface of the stock, and wherein at least an upper portion of the mounting portion of the stock insert is received within the entrance recess.

8. The mounting system according to claim 7, wherein a majority of the mounting portion of the stock insert is received within the entrance recess.

9. The mounting system according to claim 8, wherein a bottom of the mounting portion of the stock insert is substantially flush with the bottom surface of the stock of the firearm when the stock insert is mounted to the stock.

10. The mounting system according to claim 8, wherein the bottom of the mounting portion of the stock insert is arcuately curved from side to side.

11. The mounting system according to claim 1, wherein the body of the stock insert has a monolithic structure in which the mounting portion and cantilevered coupling rail are formed as integral unitary parts thereof.

12. The mounting system according to claim 1, wherein the coupling rail of the stock insert has a configuration selected from the group consisting of an ARCA rail, a Picatinny rail, a rail including longitudinal openings configured to receive T-shaped nuts on a firearm accessory which are then rotated and locked in place on the rail, and a dovetail rail.

13. The mounting system according to claim 1, wherein the mounting portion of the stock insert includes a pair of longitudinally spaced apart mounting holes each configured to receive a threaded fastener for coupling the stock insert to the stock of the firearm.

14. The mounting system according to claim 13, wherein at least one of the pair of mounting holes is formed at least partially through the coupling rail of the stock insert.

15. The mounting system according to claim 13, wherein the coupling rail is a discrete part separate from the mounting portion of the stock insert, one of the threaded fasteners coupling the coupling rail to a forward portion of the stock insert.

16. The mounting system according to claim 13, further comprising a receiver detachably coupled to the stock above the stock insert by the threaded fasteners, the threaded fasteners acting to draw the receiver, stock, and stock insert together when the threaded fasteners are tightened.

17. The mounting system according to claim 1, wherein the firearm accessory is a bipod or a tripod configured and operable to support the firearm from a support surface.

18. The mounting system according to claim 17, wherein the bipod or tripod comprises a pair of movable jaws configured and operable to lockingly engage the coupling rail of the stock insert to mount the bipod or tripod to the firearm.

19. An accessory rail mounting system for a firearm comprising:

a longitudinal axis;

an elongated stock defining a downwardly open magazine well cavity;

a stock insert comprising a longitudinally elongated body including a mounting portion configured for detachable mounting to a bottom surface of the stock at the magazine well cavity, and an elongated coupling rail cantilevered from the mounting portion;

the coupling rail being configured to detachably couple a firearm accessory thereto;

wherein the coupling rail extends forwardly from the mounting portion of the stock insert;

wherein the firearm accessory is selected from the group consisting of a flashlight, laser sight, vertical grip, and rail sling mount.

20. An accessory rail mounting system for a firearm comprising:

a longitudinal axis;

an elongated stock defining a downwardly open magazine well cavity;

a stock insert comprising a longitudinally elongated body including a mounting portion configured for detachable mounting to a bottom surface of the stock at the magazine well cavity, and an elongated coupling rail cantilevered from the mounting portion;

the coupling rail being configured to detachably couple a firearm accessory thereto;

wherein the coupling rail extends forwardly from the mounting portion of the stock insert;

wherein the mounting portion has a lateral width which is larger than a lateral width of the coupling rail.

21. An accessory rail mounting system for a firearm comprising:

a longitudinal axis;

an elongated stock defining a downwardly open magazine well cavity;

a stock insert comprising a longitudinally elongated body including a mounting portion configured for detachable mounting to a bottom surface of the stock at the magazine well cavity, and an elongated coupling rail cantilevered from the mounting portion;

the coupling rail being configured to detachably couple a firearm accessory thereto;

wherein the cantilevered coupling rail is detachably coupled to the mounting portion of the stock insert via a threaded fastener.

* * * * *